US007277659B2

(12) United States Patent
Kobayashi et al.

(10) Patent No.: US 7,277,659 B2
(45) Date of Patent: Oct. 2, 2007

(54) IMAGE FORMING APPARATUS AND SEAL RETRACTOR

(75) Inventors: Tetsuya Kobayashi, Numazu (JP); Kohei Matsuda, Shizuoka-ken (JP); Shinya Yamamoto, Numazu (JP); Masato Koyanagi, Mishima (JP); Shinichi Agata, Shizuoka-ken (JP); Kentaro Kawata, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 11/092,874

(22) Filed: Mar. 30, 2005

(65) Prior Publication Data

US 2005/0220464 A1 Oct. 6, 2005

(30) Foreign Application Priority Data

Mar. 31, 2004 (JP) ..... 2004-106285

(51) Int. Cl.
*G03G 15/08* (2006.01)

(52) U.S. Cl. ..... 399/106; 399/27

(58) Field of Classification Search ..... 399/13, 399/27, 102, 103, 106, 258
See application file for complete search history.

(56) References Cited

U.S. PATENT DOCUMENTS

| | | | | |
|---|---|---|---|---|
| 4,924,267 | A | 5/1990 | Yoshikawa et al. | 355/210 |
| 5,414,493 | A | 5/1995 | Fujii et al. | 355/200 |
| 5,471,284 | A | 11/1995 | Fujii et al. | 355/210 |
| 5,617,195 | A * | 4/1997 | Torimaru et al. | 399/27 |
| 6,178,302 | B1 | 1/2001 | Nagashima et al. | 399/106 |
| 6,266,501 | B1 * | 7/2001 | Mizuishi et al. | 399/106 |
| 6,301,457 | B1 * | 10/2001 | Chadani et al. | 399/106 X |
| 6,347,198 | B1 | 2/2002 | Yamamoto et al. | 399/27 |
| 6,529,699 | B2 | 3/2003 | Ishii et al. | 399/159 |
| 6,546,212 | B1 | 4/2003 | Ogata et al. | 399/24 |
| 6,584,291 | B1 | 6/2003 | Yamamoto | 399/27 |

(Continued)

FOREIGN PATENT DOCUMENTS

JP 3-067284 3/1991

(Continued)

OTHER PUBLICATIONS

Notification of Reason for Refusal, issued Oct. 24, 2006 in Japanese Application No. 2004-106285 and English translation thereof.

*Primary Examiner*—Sandra L. Brase
(74) *Attorney, Agent, or Firm*—Fitzpatrick, Cella, Harper & Scinto

(57) ABSTRACT

An electrophotographic image forming apparatus for forming an image on a recording material, to which a cartridge is detachably mountable. The cartridge includes portion for accommodating a developer for developing an electrostatic latent image formed on an electrophotographic photosensitive member, a roller for developing the electrostatic latent image with the developer, an opening for supplying the developer to the developing roller from the developer accommodating portion, and a sealing member for unsealably sealing the developer supply opening. The apparatus includes a detector for detecting that amount of the developer deposited on a member to be detected is less than a predetermined level, a retractor for producing an electric signal for retracting the sealing member from a sealing position where the sealing member seals the developer supply opening, when the detector detects that amount of the developer deposited on the member to be detected is less than the predetermined level.

11 Claims, 21 Drawing Sheets

U.S. PATENT DOCUMENTS

| | | | | |
|---|---|---|---|---|
| 6,587,649 | B1 | 7/2003 | Yamamoto et al. | 399/27 |
| 6,594,451 | B2 | 7/2003 | Kakeshita et al. | 399/24 |
| 6,892,033 | B2 | 5/2005 | Sunada et al. | 399/13 |
| 6,912,366 | B1 | 6/2005 | Yamamoto et al. | 399/27 |
| 6,925,267 | B2 | 8/2005 | Yamamoto et al. | 399/27 |
| 6,983,120 | B2 | 6/2006 | Ishii et al. | 399/346 |
| 7,058,320 | B2 | 6/2006 | Yamamoto et al. | 399/27 |
| 7,068,955 | B2 | 6/2006 | Yamamoto et al. | 399/27 |
| 2003/0053809 | A1 | 3/2003 | Ogata et al. | 399/12 |
| 2005/0152716 | A1 | 7/2005 | Agata et al. | 399/223 |
| 2005/0220464 | A1 | 10/2005 | Kobayashi et al. | 399/27 |

FOREIGN PATENT DOCUMENTS

| | | |
|---|---|---|
| JP | 11-231757 | 8/1999 |
| JP | 2002-278240 | 9/2002 |
| JP | 2003-270901 | 9/2003 |

* cited by examiner

IMAGE FORMING APPARATUS AND SEAL RETRACTOR

FIELD OF THE INVENTION AND RELATED ART

The present invention relates to an electrophotographic image forming apparatus in which a cartridge, the developer supply opening of which is sealed, can be removably mountable, and a sealing member retracting mechanism.

Here, an electrophotographic image forming apparatus means an apparatus for forming an image on recording medium with the use of one of the electrophotographic image forming methods. As for examples of an electrophotographic image forming apparatus, an electrophotographic copying machine, an electrophotographic printer (for example, laser beam printer, LED printer, etc.), a facsimileing machine, a wordprocessor, etc., are included.

Here, a cartridge means a cartridge removably mountable in an electrophotographic image forming apparatus. It includes a development cartridge, a process cartridge, etc. A development cartridge means a development unit in the form of a cartridge in which a developing means for developing an electrostatic latent image formed on an electrophotographic photosensitive member, and a developer storage portion for storing the developer to be used for the development of the electrostatic latent image, are integrally disposed, and which is removably mountable in the main assembly of an electrophotographic image forming apparatus. A process cartridge means a processing unit in the form of a cartridge in which an electrophotographic photosensitive member, and a single or plurality of processing means which act on the electrophotographic photosensitive member, are integrally disposed, and which is removably mountable in the main assembly of an electrophotographic image forming apparatus. A processing means means a charging means for charging the electrophotographic photosensitive drum, a developing means for developing the electrostatic latent image formed on the electrophotographic photosensitive member, a cleaning means for removing the developer remaining on the electrophotographic photosensitive member, etc.

A process cartridge system has long been employed in the field of an electrophotographic image forming apparatus which uses an electrophotographic image formation process. A process cartridge system is a system in which an electrophotographic photosensitive member, and a developer processing means which acts on the electrophotographic photosensitive member, are integrally disposed in a cartridge removably mountable in the main assembly of an electrophotographic image forming apparatus, as described above. A process cartridge system makes it possible for a user to maintain an electrophotographic image forming apparatus without relying on a service person, drastically improving an electrophotographic image forming apparatus in operability. Thus, a process cartridge is widely in use in the field of an electrophotographic image forming apparatus.

As for the image forming operation of an electrophotographic image forming apparatus, a beam of light is projected from a laser, an LED, an ordinary light source, or the like, while being modulated with image formation data, onto the electrophotographic photosensitive member (which hereinafter will be referred to simply as photosensitive drum) in the form of a drum. As a result, an electrophotographic latent image is formed on the peripheral surface of the photosensitive drum. This electrophotographic latent image is developed by a development unit, which is an integral part of a process cartridge. The developed electrostatic latent image, that is, an image formed of the developer, on the peripheral surface of the photosensitive drum, is transferred onto recording medium; in other words, an image is formed on the recording medium.

Referring to FIG. 1, as an example of an image forming apparatus which employs a single or plurality of process cartridges such as the above described one, there is an electrophotographic color image forming apparatus 100 which employs a plurality of process cartridges, which are vertically stacked in parallel.

There has been the following proposal regarding a process cartridge removably mountable in an image forming apparatus such as the above described one. That is, a developer storage portion (which hereinafter will be referred to as developer container) which stores developer is joined with a developing means container which holds a developer bearing member, a developer regulating member, etc., and the opening of the developer container, which functions as the developer supply passage, through which the developer is supplied from the developer container to the developing means container, is sealed with a developer container sealing member, such as a developer seal, in order to prevent the developer from flowing into the developing means container before the process cartridge is used for the first time.

It has been a common practice to improve a monochromatic image forming apparatus in usability by making it possible to automatically remove the developer container seal with the use of the driving force source of the main assembly of the image forming apparatus.

In the case of a process cartridge for an image forming apparatus which employs a plurality of process cartridges, that is, a plurality of development units, it has been necessary for a user to remove the developer container seal from each of the development units by pulling the pull-tab of the process cartridge, to which the developer container seal is attached, if the process cartridge to be mounted into the main assembly of an image forming apparatus is brand-new.

In comparison, a monochromatic image forming apparatus has been structured so that, as the developer container seal is automatically removed with the use of the driving force source of the main assembly of the image forming apparatus, the electrical connection is interrupted to ensure a user that the developer container sealer has been removed (U.S. Pat. No. 6,178,302).

The amount by which developer is consumed for forming an image is affected by various factors, for example, the ambient temperature and humidity in which a color image forming apparatus is used, the frequency with which a photosensitive drum is used, the number of copies to be made, etc. The variation in this amount of developer results in the variation in the density of the printed image, which in turn is recognized by a user (viewer) as variation in tone. Thus, a large number of color image forming apparatuses are equipped with a mechanism for automatically adjusting such factors as the potential level to which an image bearing member is charged, the amount of exposure, the potential level of development bias, etc., which affect the conditions under which an image is formed. As for the operation of this mechanism, an image is formed of developer on the photosensitive drum or a conveyer belt, in order to control the image formation condition. Then, the density of the image formed of developer (which hereinafter will be referred to simply as developer image) is detected, and the image formation conditions are controlled based on the results of the detection. As a developer image detecting means used for controlling the image formation conditions, there is a developer image detecting means which detects the density of a developer image with the use of an optical sensor. Some image forming apparatuses are equipped with a developer image detecting means of this type (Japanese Laid-open Patent Application 2003-270901).

SUMMARY OF THE INVENTION

The present invention is one of the further developments of an electrophotographic image forming apparatus of the above described type.

The primary object of the present invention is to provide an electrophotographic image forming apparatus and a sealing member retraction mechanism, which do not require a user to unseal the developer supply passage of a cartridge.

Another object of the present invention is to provide an electrophotographic image forming apparatus and a sealing member retraction mechanism, which are capable of detecting that the developer supply passage is not open, by detecting that the amount of developer on a predetermined developer image bearing medium is no more than a predetermined value.

Another object of the present invention is to provide an electrophotographic image forming apparatus and a sealing member retraction mechanism, which automatically retract the sealing member from the developer supply passage as it is detected that the amount of developer on a predetermined developer image bearing medium is no more than a predetermined value.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings.

Embodiment 1

Figure 1:
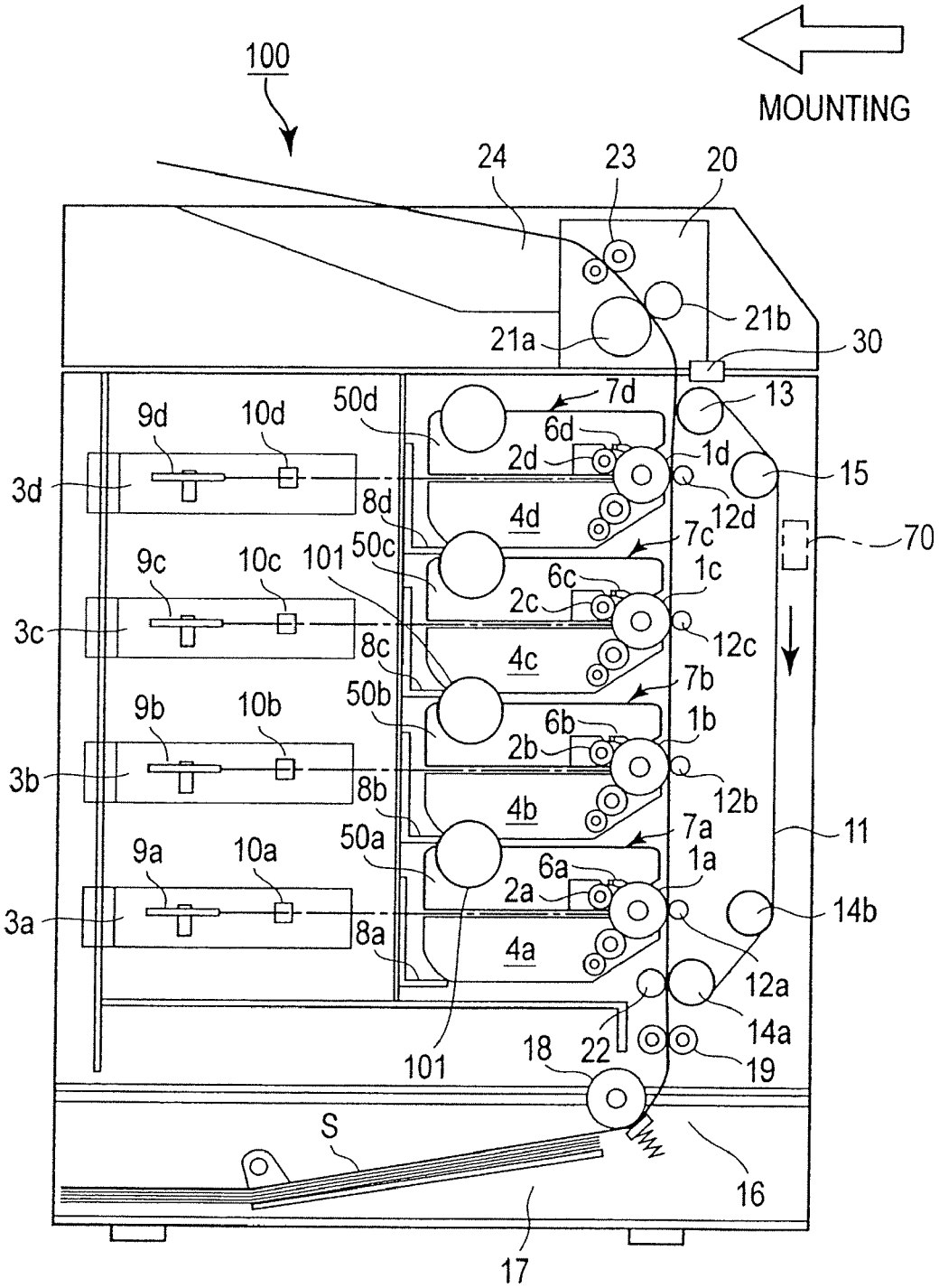
FIG. 1 is a schematic drawing of an electrophotographic color image forming apparatus in the first embodiment of the present invention, showing the general structure thereof.

FIG. 1 is a schematic drawing of the electrophotographic color image forming apparatus in the first embodiment of the present invention, and shows the general structure thereof. First, the general structure of the electrophotographic color image forming apparatus will be described with reference to FIG. 1. In this embodiment, it is assumed that each of the developments units is an integral part of the corresponding process cartridge removably mountable in the main assembly of the image forming apparatus.

(General Structure of Image Forming Apparatus)

Referring to FIG. 1, the main assembly 100 of the electrophotographic color image forming apparatus has four process cartridge compartments 8 (8*a*, 8*b*, 8*c*, and 8*d*), which are vertically stacked in parallel. The process cartridges 7 (7*a*, 7*b*, 7*c*, and 7*d*) are mounted into these process cartridge compartments 8 one for one. Each process cartridge 7 comprises an electrophotographic photosensitive drum 1 (1*a*, 1*b*, 1*c*, or 1*d*), which is rotationally driven by the driving means in the counterclockwise direction of the drawing.

In the adjacencies of the peripheral surface of the photosensitive drum 1, a plurality of processing means are disposed in a manner of surrounding the peripheral surface of the photosensitive drum 1. These processing means will be described in the order in which they are disposed in terms of the rotational direction of the photosensitive drum 1, starting with the charging means 2 (2*a*, 2*b*, 2*c*, and 2*d*) for uniformly charging the peripheral surface of the photosensitive drum 1. Disposed next to the charging means 2 is the scanner unit 3 (3*a*, 3*b*, 3*c*, and 3*d*) for forming an electrostatic latent image on the peripheral surface of the photosensitive drum 1 by projecting a beam of laser light, while modulating it with image formation data, onto the peripheral surface of the photosensitive drum 1. Disposed next to the scanner unit 3 is the development unit 4 (4*a*, 4*b*, 4*c*, and 4*d*) for developing the electrostatic latent image into a visible image, that is, an image formed of developer, with the use of developer. Next to the development unit 4, the electrostatic transferring means 12 (12*a*, 12*b*, 12*c*, and 12*d*) is disposed, which transfers the developer image on the peripheral surface of the photosensitive drum 1 onto a recording medium S. Lastly, next to the electrostatic transferring means 12, the cleaning means 6 (6*a*, 6*b*, 6*c*, and 6*d*) for removing the developer remaining on the peripheral surface of the photosensitive drum 1 after the transfer of the developer image, is disposed.

In this embodiment, the photosensitive drum 1, charging means 2, development unit 4, and cleaning means 6 are integrally disposed in a cartridge, making up a process cartridge 7.

The photosensitive drum 1 is made up of an aluminum cylinder with a diameter of 30 mm, for example, and a layer of organic photoconductor (OPC) coated on the peripheral surface of the aluminum cylinder. It is rotatably supported by a supporting member (unshown), by the lengthwise ends. Referring to FIG. 3, the photosensitive drum 1 is provided with a drum gear 114, which is attached to one of the lengthwise ends, and through which driving force is transmitted to the photosensitive drum 1 from a motor 101 through a drive train made up of gears, rotationally driving the photosensitive drum 1 in the clockwise direction indicated by an arrow mark X in FIG. 3 (counterclockwise direction X in FIG. 2), at a peripheral velocity of 94.2 mm/sec.

Figure 2:
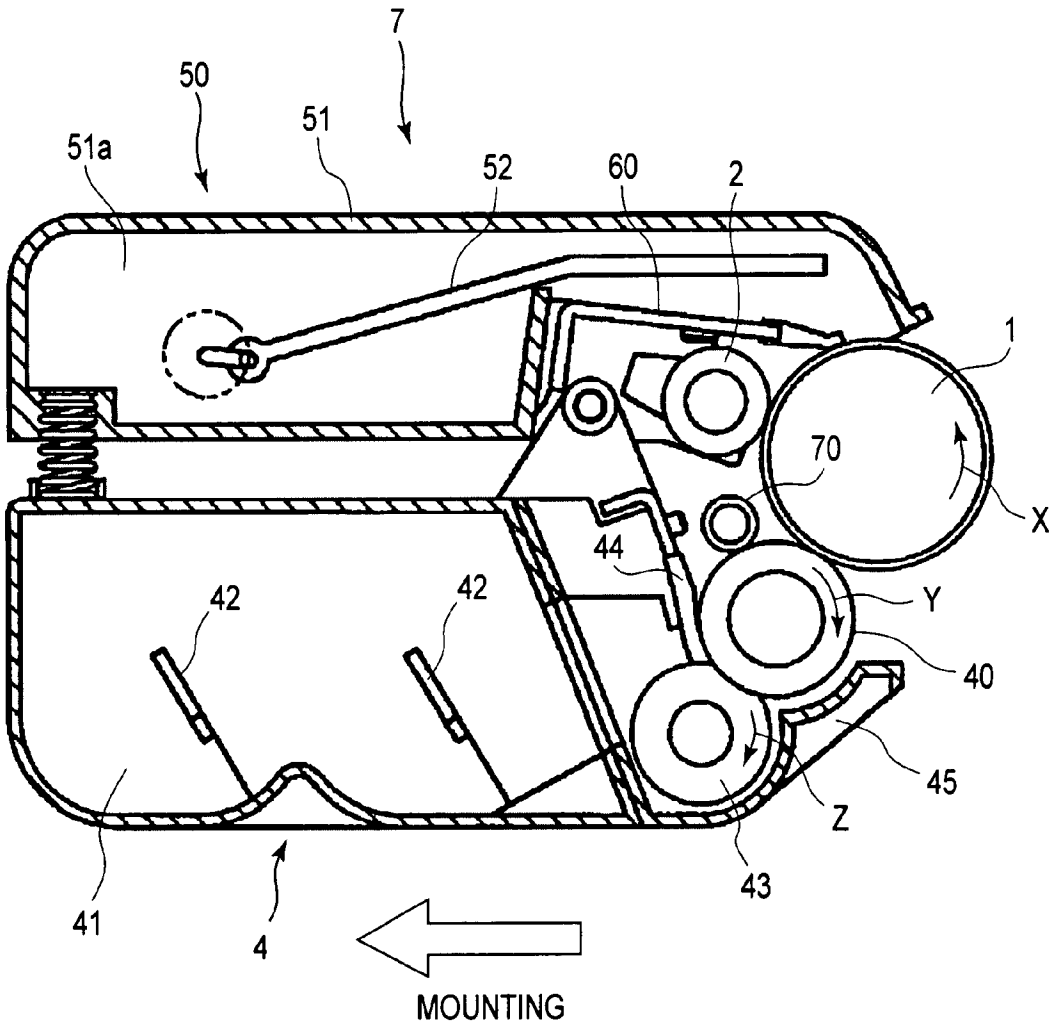
FIG. 2 is a sectional view of the process cartridge in the first embodiment, showing the general structure thereof.
Figure 3:
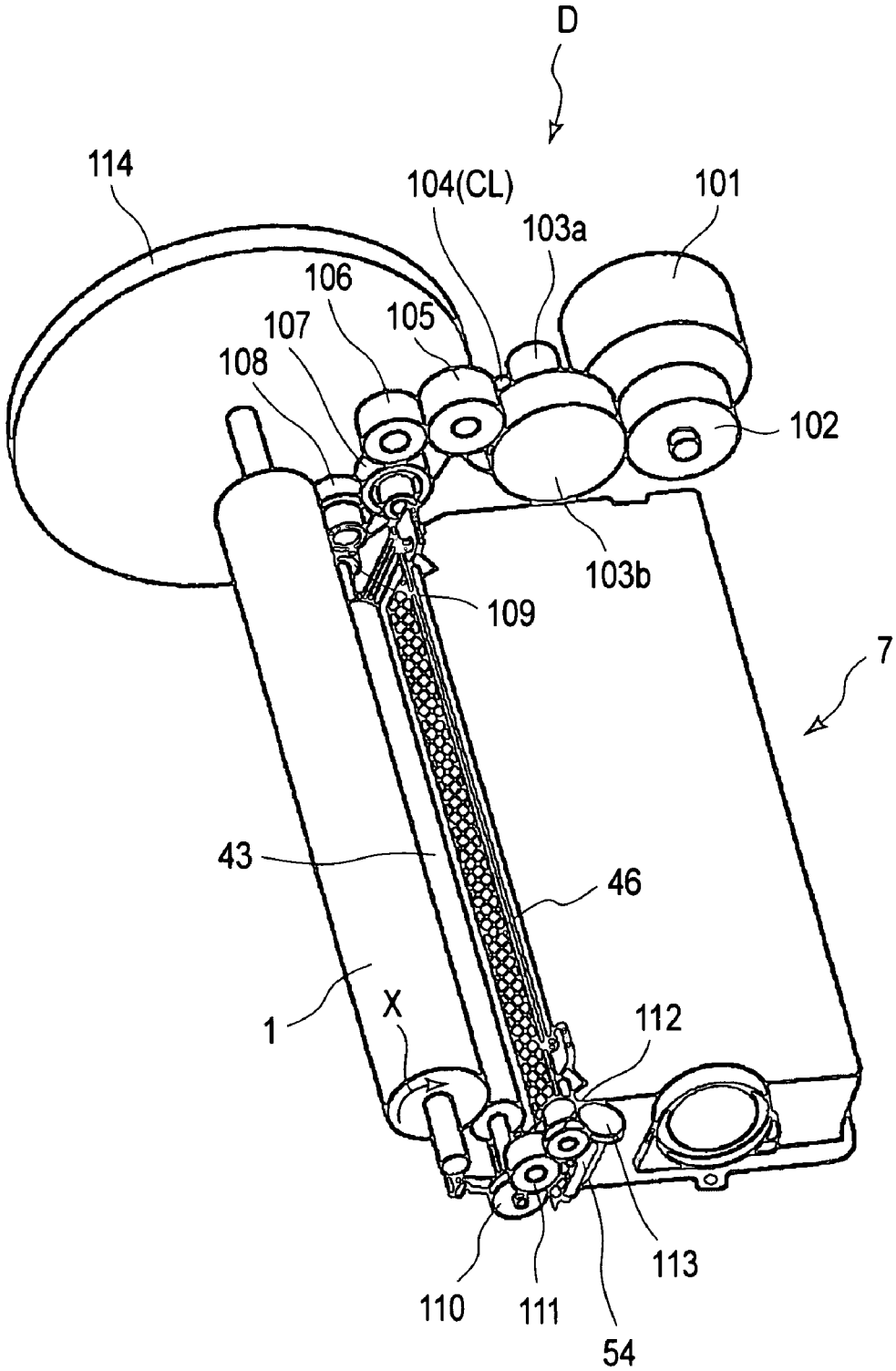
FIG. 3 is a perspective view of the driving means of the process cartridge, showing the general structure thereof.

The charging means 2 (2*a*, 2*b*, 2*c*, and 2*d*) employed in this embodiment is of the contact type shown in FIG. 2. It is in the form of an electrically conductive roller (charging member), which is placed in contact with the peripheral surface of the photosensitive drum 1. As charge bias voltage is applied to the roller 2, the peripheral surface of the photosensitive drum 1 is uniformly charged.

Each of the scanner units 3 (3*a*-3*d*) is disposed in the direction roughly horizontal to the corresponding photosensitive drum 1. A beam of light as an image forming light is projected, while being modulated with video signals, from the laser diode (unshown) onto the polygon mirror 9 (9*a*, 9*b*, 9*c*, and 9*d*) which is being rotated. The beam of image forming light is reflected by the mirror 9, and focused on the peripheral surface of the charged peripheral surface of the photosensitive drum 1 through a focal lens 10 (10*a*, 10*b*, 10*c*, and 10*d*), selectively illuminating (exposing) the numerous points of the charged peripheral surface of the photosensitive drum 1. As a result, an electrostatic latent image reflecting the video signals is formed.

As will be understood from FIG. 2, the development units 4 (4*a*, 4*b*, 4*c*, and 4*d*) each have developer storage portions, that is, developer containers 41, and developing means holding frames, that is, developing means containers 45, respectively.

To describe the developer containers 41 in more detail, the yellow development unit 4*a* has the developer container 41 which stores the developer of yellow color; the magenta development unit 4*b* has the developer container 41 which stores the developer of magenta color; the cyan development unit 4*c* has the developer container 41 which stores the developer of cyan color; and the black development unit 4*d* has the developer container 41 which stores the developer of black color. Each developer container 41 is provided with a development roller 40 as a developer bearing member for conveying developer, which is disposed in the developer container 41 in a manner of opposing the photosensitive drum 1.

Also referring to FIG. 2, the developer, that is, a developing agent, in the developer container 41 is sent to the developer supply roller 43 by a mechanism 42 for conveying developer while stirring it. Then, the developer is coated on the peripheral surface of the development roller 40, while being give electric charge, by the developer supply roller 43 and a development blade 44 kept pressed upon the peripheral surface of the development roller 40. Then, as development bias is applied to the development roller 40, the latent image on the peripheral surface of the photosensitive drum 1 is developed into a developer image.

Next, referring to FIG. 1, the main assembly 100 of the image forming apparatus is provided with a conveyer belt 11, which is circularly driven in contact with all of the photosensitive drums 1*a*-1*d*. The conveyer belt 11 is formed of roughly 150 m thick film, the specific volumetric resistivity of which is in the range of $10^{11}$-$10^{14}$ Ω·cm. The recording medium S is conveyed by the conveyer belt 11 to the transfer point, at which the developer image on the peripheral surface of the photosensitive drum 1 is transferred onto the recording medium S.

To describe in more detail the conveyer belt 11 and the components related thereto, the conveyer belt 11 is stretched around four rollers, that is, a driver roller 13, follower rollers 14*a* and 14*b*, and a tension roller 15, and is circularly moved in the direction indicated by an arrow mark in FIG. 1, bearing the recording medium S, so that the developer image is transferred onto the recording medium S while the recording medium S is conveyed from the follower roller 14*a* side to the driving roller 13 side. The main assembly 100 is provided with a developer image detection sensor 30 as a developer image detecting means, which is disposed above the driver roller 30, a predetermined distance away from the conveyer belt 11, to detect the density of the developer image transferred directly onto the conveyer belt 11 to control the image control conditions which affect image properties such as density.

The main assembly 100 is also provided with transfer rollers 12 (12*a*, 12*b*, 12*c*, and 12*d*) as transferring means, which are disposed in parallel, in contact with the inward surface of the conveyer belt 11, with respect to the loop the conveyer belt 11 forms, in a manner of opposing the four photosensitive drums 1 (1*a*, 1*b*, 1*c*, and 1*d*), respectively. From these transfer rollers 12, positive electric charge is applied to the recording medium S through the conveyer belt 11. As a result, the developer image on the photosensitive drum 1 is transferred onto the recording medium S.

The paper feeding portion 16 is the portion that feeds the recording medium S into the main assembly 100 and conveys it to the image forming portion. The paper feeder cassette 17 holds a plurality of recording mediums S. During image formation, a feeder roller 18 and a pair of registration rollers 19 are rotationally driven in synchronism with the progress of the image forming operation. More specifically, as the feeder roller 18 is rotated, the recording mediums S in the cassette 17 are fed into the main assembly 100 while being separated one by one. As the leading edge of the recording medium S reaches the pair of registration rollers 19, the recording medium S is temporarily held up, and then, is released by the pair of registration rollers 19 in synchronism with the rotation of the conveyer belt 11 and the progression of the formation of the developer image, to be conveyed to the conveyer belt 11.

The fixing portion 20 is the portion for fixing the plurality of developer images different in color to the recording medium S after the transfer of the developer images onto the recording medium S. It comprises a rotatable heat roller 21*a*, and a pressure roller 21*b* kept pressed upon the heat roller 21*a* to apply heat and pressure to the recording medium S. More specifically, after the transfer of the developer images on the photosensitive drum 1, onto the recording medium S, the recording medium S is conveyed through the fixing portion 20 by the fixation roller pairs, that is, the heat roller 21*a* and pressure roller 21*b*. While the recording medium S is conveyed through the fixing portion 20, heat and pressure are applied to the recording medium S and the developer images thereon. As a result, the plurality of developer images are permanently fixed to the surface of the recording medium S.

The image forming operation by the above described image forming apparatus is as follows:

First, the process cartridges 7 (7*a*, 7*b*, 7*c*, and 7*d*) are sequentially driven in synchronism with the progression of the image forming operation. Thus, the photosensitive drums 1 (1*a*, 1*b*, 1*c*, and 1*d*) are sequentially driven by the driving force transmitted to the process cartridges 7, along with the scanner units 3 (3*a*, 3*b*, 3*c*, and 3*d*) which correspond to the photosensitive drums 1 (1*a*, 1*b*, 1*c*, and 1*d*), respectively. Also as the process cartridges 7 are driven, the charging means 2 (2*a*, 2*b*, 2*c*, and 2*d*) uniformly charge the peripheral surfaces of the photosensitive drums 1. Each scanner unit 3 illuminates (exposes) the peripheral surface of the corresponding photosensitive drum 1 with a beam of light being modulated with video signals, forming thereby an electrostatic latent image on the photosensitive drum 1. The development roller 40 develops the electrostatic latent image. In this embodiment, the development roller 40 is enabled by an unshown pivotal mechanism to pivot with the development unit 4, and is kept separated from the photosensitive drum 1 during the standby period in which image formation data are inputted into the image forming apparatus. The development unit 4 is pivotally moved to place the development roller 40 in contact with the photosensitive drum 1 when carrying out the development process. When it is said in the following description of this embodiment that the rotational driving of the development roller 40 is started, this means that the development roller 40 is placed in contact with the photosensitive drum 1 after it begins to be rotated, whereas, when it is said that the rotational driving of the development roller 40 is stopped, this means that the development roller 40 is separated from the photosensitive drum 1 after the rotational driving of the development roller 40 is stopped.

As described above, the developer images formed sequentially on the plurality of photosensitive drums 1 are sequentially transferred onto the recording medium S by the electric fields formed between the photosensitive drums 1 and corresponding transfer rollers 12. After the transfer of the four developer images different in color onto the recording medium S, the recording medium S is separated from the conveyer belt 11 by the curvature of the driver roller 13, and is conveyed into the fixing portion 20, in which the four developer images are thermally fixed to the recording medium S. Then, the recording medium S is discharged from the apparatus main assembly 100 by a pair of discharge rollers 23 through the recording medium discharging portion 24.

(Process Cartridge)

Next, referring to FIG. 2, the process cartridge 7 (7*a*, 7*b*, 7*c*, and 7*d*) in this embodiment will be described. FIG. 2 is a sectional view of the process cartridge 7 which stores developer, at a plane perpendicular to the lengthwise direction of the process cartridge 7.

Incidentally, the process cartridge 7*a*storing the developer of yellow color, process cartridge 7*b* storing the developer of magenta color, process cartridge 7*c* storing the developer of cyan color, and process cartridge 7*d* storing the developer of black color are identical in structure.

Each process cartridge 7 is separable into a photosensitive drum unit 50 as a first portion, and a development unit 4 as a second portion. The drum unit 50 has the photosensitive drum 1, charging means 2, and cleaning means 6, and the development unit 4 has the developing means.

The photosensitive drum 1 is rotatably attached to the cleaning means frame 51 of the photosensitive drum unit 50, with the interposition of a pair of bearings (unshown). As described above, in the adjacencies of the peripheral surface of the photosensitive drum 1, the charging means 2 for uniformly charging the peripheral surface of the photosensitive drum 1, and a cleaning blade 60 for removing the developer remaining on the peripheral surface of the photosensitive drum 1 (which hereinafter may be referred to simply as residual developer), are disposed. After being removed from the peripheral surface of the photosensitive drum 1 by the cleaning blade 60, the residual developer is conveyed by a developer conveying mechanism 52 into a waste developer chamber 51*a* located in the rear portion of the cleaning means frame 1 as it is removed. The photosensitive drum 1 is rotationally driven in the direction (counterclockwise direction) indicated by the arrow mark X in the drawing, by transmitting the driving force from the motor 101 located at one end of the rear portion of the cleaning means frame (FIG. 3).

At this time, referring to FIG. 3, the driving force transmitting means D of the process cartridge 7 will be described.

In this embodiment, the driving force generated by the main assembly motor 101, with which the apparatus main assembly 100 is provided, is transmitted from the driving gear 102 to a stepped gear 103 (made up of portions 103*a* and 103*b*). A part of the driving force is transmitted to a gear 104 on the photosensitive drum side through the portion 103*a* of the stepped gear 103, and the rest is transmitted to a gear 105 on the developing means container side through the portion 103*b* of the stepped gear 103.

The portion of the driving force from the main assembly motor 101 transmitted to the gear 105 on the developing container side is transmitted through a gear 106, a gear 107, a stepped gear 108, and a gear 109 to drive the developer supply roller 43. Further, the driving force transmitted to the developer supply roller 43 is transmitted to a gear 113 from a gear 110 attached to the opposite lengthwise end of the developer supply roller 43 from the side to which the driving force is transmitted from the motor 101, via elements 111 and 112. Although it is not shown in the drawing, one of the lengthwise ends of the shaft of the development roller 40 is attached to a stepped gear 108 through which the driving force is transmitted to the development roller 40.

A gear 113 is a part of a sealing member winding shaft 54 as a sealing member retracting member for retracting the sealing member 46, and is integrally formed with the shaft 54. Thus, as the above described driving force is transmitted to the gear 113, the driving force is transmitted to the sealing member winding shaft 54 (which hereinafter will be referred to simply as winding shaft 54) integral with the gear 113. This process will be described later in detail.

As for the part of the driving force transmitted to the gear 104 on the photosensitive drum side from the portion 103*a* of the stepped gear 103, it is transmitted from the gear 104 to a gear 114 to drive the photosensitive drum 1.

Referring to FIG. 2, the development unit 4 comprises: the development roller 40 as a developer bearing member, which is rotated in the direction indicated by an arrow mark Y, in contact with the photosensitive drum 1; developing means container 45 (developing means frame) in which the development roller 40 is disposed; and developer container 41 in which developer is stored.

The development roller 40 is rotatably supported by the developing means container 45. In the adjacencies of the peripheral surface of the development roller 40, the developer supply roller 43 as a developer supplying member which rotates in the direction indicated by an arrow mark Z, in contact with the development roller 40, and a development blade 44 as a developer regulating member, are disposed. In the developer container 41, the aforementioned mechanism 42 for conveying the developer in the developer container 41, to the developer supply roller 43 while stirring it, is disposed.

As for the development process, the developer in the developer container 41 is conveyed by the developer conveying and stirring mechanism 42 to the developer supply roller 43, which rotates in the direction indicated by the arrow mark in FIG. 2. As the developer supply roller 43 rotates, it rubs against the peripheral surface of the development roller 40 which is rotating in the direction indicated by the arrow mark in the drawing. As a result, the developer on the developer supply roller 43 is borne on the development roller 40; the development roller 40 is supplied with the developer. Then, with the rotation of the development roller 40, the body of the developer on the peripheral surface of the development roller 40 reaches the development blade 44, by which the body of the developer is regulated in thickness, being thereby formed into a thin layer of developer with a predetermined thickness. Then, with the further rotation of the development roller 40, the thin layer of developer reaches a charge roller 70 as a developer charging means, by which the developer is given a predetermined amount of electrical charge.

Next, with the further rotation of the development roller 40, the thin layer of developer on the development roller 40 reaches the developing portion, that is, the contact area between the photosensitive drum 1 and development roller 40. In the developing portion, development bias (DC voltage) is applied to the development roller 40 from an unshown electrical power source, whereby the developer on the development roller 40 is adhered to the peripheral surface of the photosensitive drum 1 in the pattern of the electrostatic latent image thereon; the latent image is developed. The developer remaining on the peripheral surface of the peripheral surface of the development roller 40, that is, the developer which did not contribute to the development of the latent image, is returned to the developing means container 45 by the rotation of the development roller 40. Then, the developer remaining on the development roller 40 is stripped away from the development roller 40 by the developer supply roller 43 which is rubbing against the development roller 40; it is recovered into the developing means container 45. The recovered developer is mixed with the rest of the developer in the developing means container 45 by the developer conveying and stirring mechanism 42.

In the case of a developing method of the contact type, like the one employed in this embodiment, in which the development roller 40 is placed in contact with the photosensitive drum 1 in order to develop a latent image on the photosensitive drum 1, it is desired that the photosensitive drum 1 is a rigid member, whereas the development roller 40 is made up of a rigid axle, and elastic roller fitted around the rigid axle. As for the material for the elastic portion of the development roller 40, a solid rubber roller or the like may be employed. In consideration of the fact that the development roller 40 is required to give the developer electrical charge, the solid rubber layer may be coated with resin.

Referring to FIGS. 1 and 2, as for the mounting of the process cartridge 7 into the main assembly 100 of the image forming apparatus, the process cartridge 7 is to be inserted from the direction indicated by an arrow mark, so that it will be guided by the process cartridge guides, with which the apparatus main assembly 100 is provided, into the predetermined position in the main assembly 100.

Next, referring to FIGS. 4-11 as well as FIGS. 1 and 2, the sealing member 46 (which hereinafter will be referred to as developer seal) for unsealably sealing the opening 41*e* as a developer supply passage, with which the development unit 4 is provided, and developer seal winding mechanism for winding up the developer seal 46 to retract from the position in which the developer seal 46 keeps the developer supply passage 41*e* blocked, in order to open the passage 41*e*, will be described along with the sequence for opening the developer supply passage 41*e*.

(Developer Seal Retracting Portion)

Figure 4:
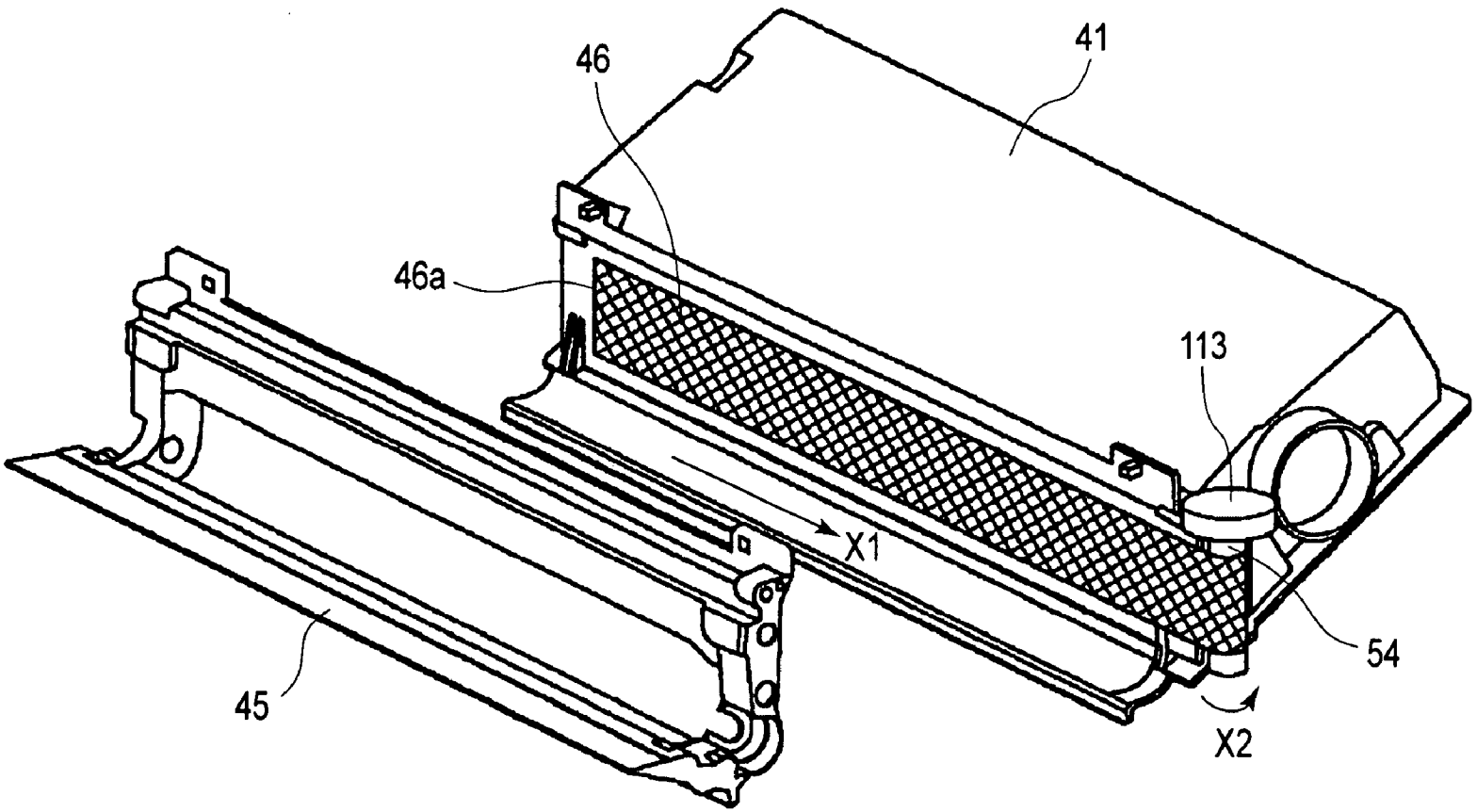
FIG. 4 is a perspective view of the development unit of the process cartridge, showing the general structure thereof.
Figure 5:
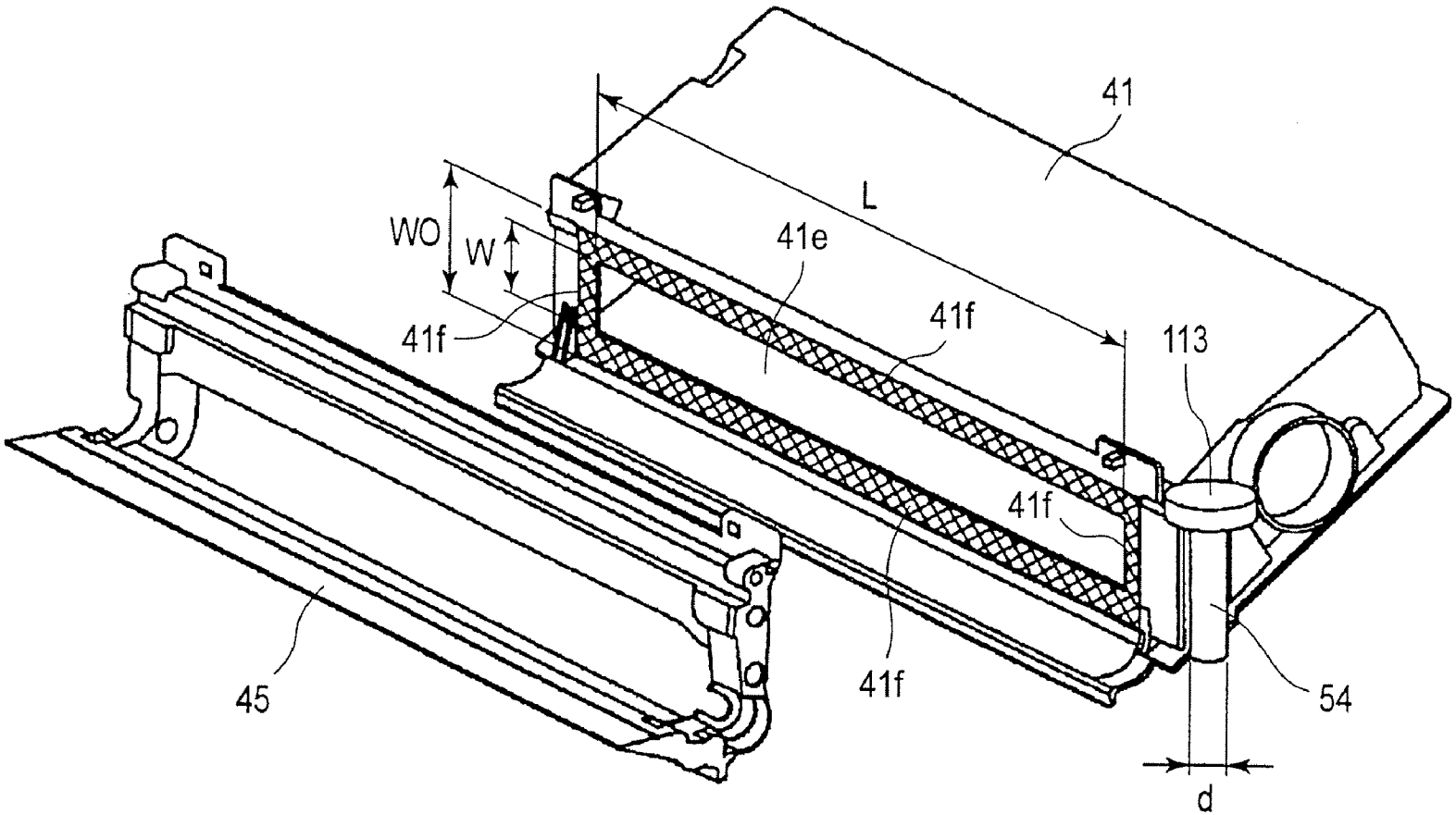
FIG. 5 is a perspective view of the development unit of the process cartridge, showing the general structure thereof.

FIGS. 4 and 5 show the developer container 41 and developing means container 45. Referring to FIG. 5, there is the opening 41*e*, between the developer container 41 and developing means container 45, through which the developer is sent from the developer container 41 to developing means container 45 (development roller 40). The opening 41*e* is surrounded by a developer seal attachment surface 41*f*, to which the developer seal 46 is welded. The developer seal 46 will be described later.

FIG. 4 shows the developing means container 45, and the developer seal 46 attached to the developer seal attachment surface 41*f* of the developer container 41, which surrounds the opening 41*e*. The developer seal 46 is a piece of film. It is attached to the developer seal attachment surface 41*f* by, welding, gluing, or the like means, so that the opening 41*e* of the developer container 41, shown in FIG. 5, is completely blocked by the developer seal 46 (FIG. 4).

More specifically, the developer seal 46 is adhered to the developer seal attachment surface 41*f*, starting from one of the lengthwise edges of the opening 41*e* to the other edge, and is doubled back from the edge to the opposite edge, or the starting point, where it is attached to the winding shaft 54 as the sealing member retracting member. The developer seal 46 is securely attached to the winding shaft 54 with the use of an unshown adhesive member. The developer seal 46 can be peeled away (separated) from the developer seal attachment surface 41*f*, by pulling it in the direction indicated by an arrow mark X1, by the end portion. As the developer seal 46 is peeled away, the opening 41*e* is exposed; the developer supply passage is opened. The developer seal 46 is peeled away (separated) by rotating the winding shaft 54 in the direction indicated by an arrow mark X2. The winding shaft 54 is driven in the following manner.

As described above with reference to FIG. 3, the driving force from the motor 101 of the driving means D of the main assembly 100 is transmitted to the driving gear train, and from the gear train, the driving force is transmitted to the development roller 40, developer supply roller 43, and developer conveying and stirring mechanism 42, which are in the development unit 4 of the process cartridge 7.

Further, the driving force is transmitted to the winding shaft 54 as a sealing member retracting member, from the opposite end of the developer supply roller 43 from the end to which the driving force is transmitted from the motor 101, and drives the winding shaft 54. In other words, the process cartridge 7 is structured so that the developer supply roller 43 and winding shaft 54 are driven by the same driving force source. The employment of this structural arrangement eliminates the need for a driving force source dedicated to the removal of the developer seal 46, eliminating therefore the need for the space therefor while simplifying the structure for driving the winding shaft 54. In this embodiment, the development roller 40, developer supply roller 43, developer conveying and stirring mechanism 42, and winding shaft 54 are not provided with a clutching mechanism, reducing thereby the cost of achieving the above described effects.

As for the choices for the developer seal 46, there is available a combination of a cover film for sealing the opening 41*e* of the developer container 41, and a tear tape for tearing the cover film, in addition to the above described developer seal 46 of the easy-peel type, that is, a single piece of tape which is folded back. Obviously, this embodiment is compatible with a developer seal (46) of such a type.

In this embodiment, the sealing member for sealing the opening 41*e* of the developer container 41 is described as the developer seal 46 in the form of a piece of film. However, the sealing member 46 may be in the form of a piece of plate; which can be slid in the lengthwise direction of the process cartridge 7 (direction parallel to axial line of photosensitive drum 1) to expose the opening 41*e* of the developer container 41. Further, the sealing member 46 in the form of a piece of plate may be slid in the direction perpendicular to the lengthwise direction of the process cartridge 7. Moreover, the sealing member 46 may be structured so that it can be moved back into the sealing position to reseal the opening 41*e* after being retracted to expose the opening 41*e*.

(Developer Image Detecting Portion)

Figure 6:
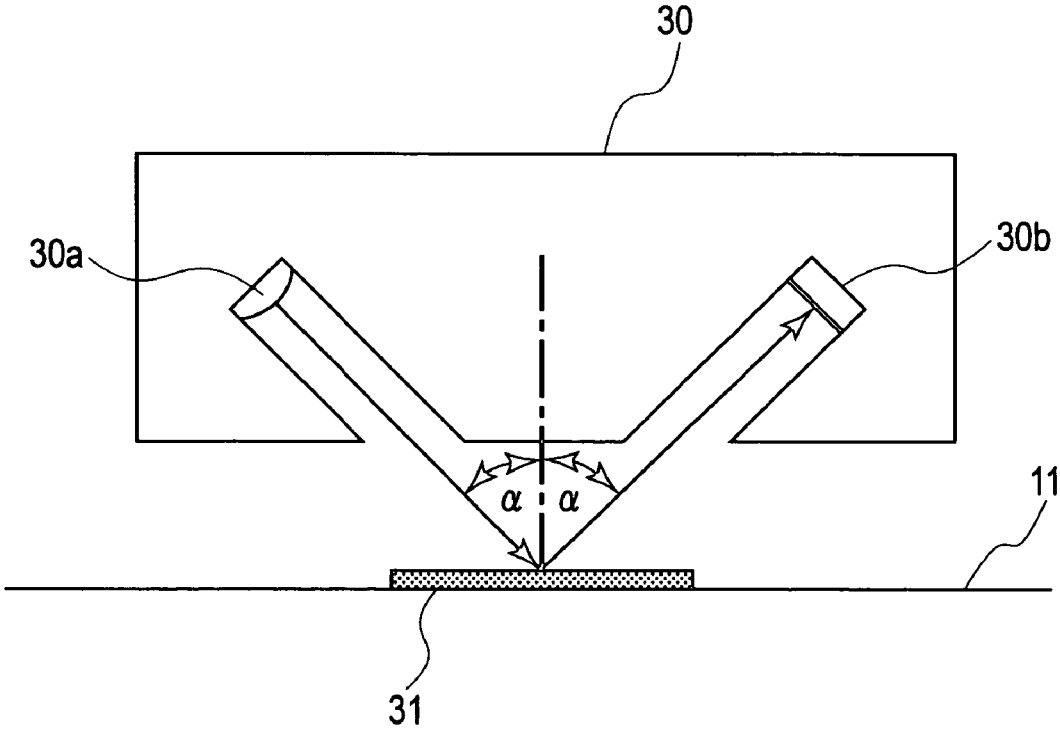
FIG. 6 is a sectional view of the developer image detecting means in the first embodiment of the present invention.
Figure 7:
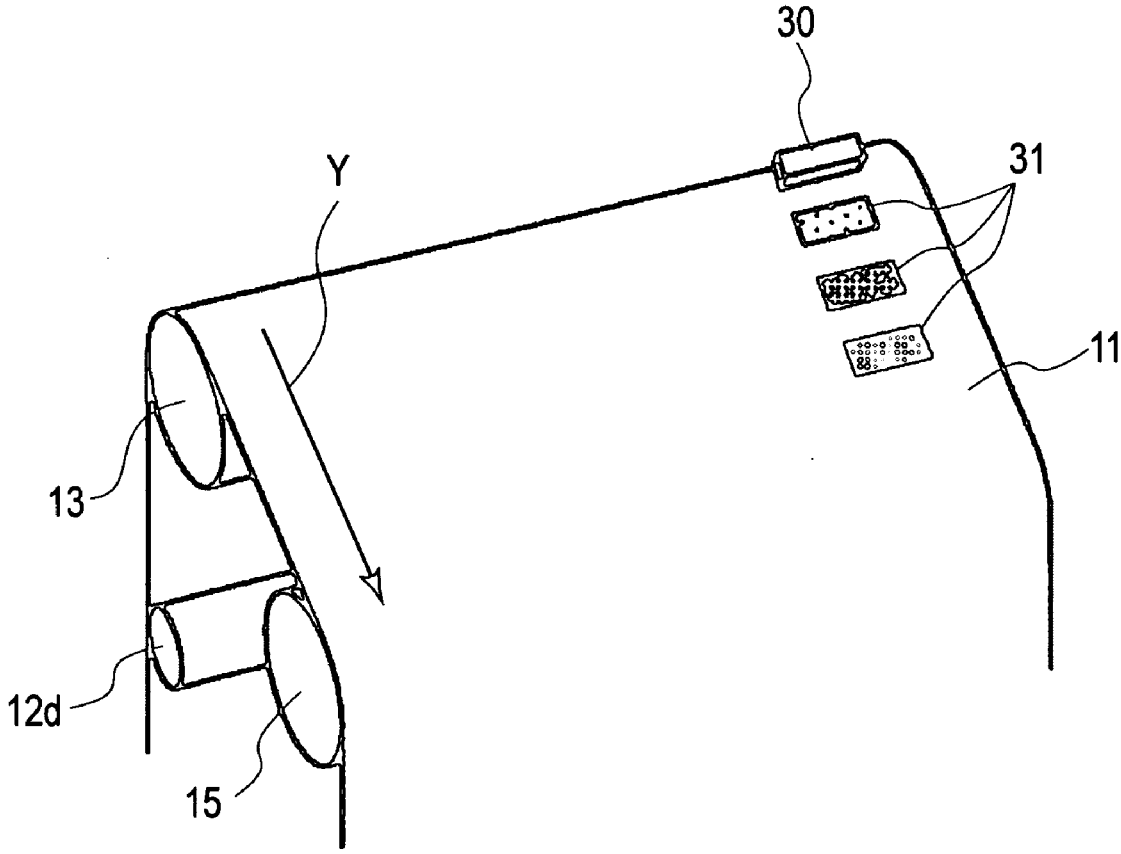
FIG. 7 is a perspective view of the developer image detecting means, depicting the process of detecting a developer image.

FIGS. 6 and 7 are schematic drawings of the developer image detection sensor 30 as a developer image detecting means in this embodiment. The developer image detection sensor 30 has a light emitting element 30*a* and a light receiving element 30*b*, and is disposed so that it faces the conveyer belt 11 as an object onto which a developer image 31 to be detected is transferred. The light emitting element 30*a* projects infrared light toward the developer image 31. The light emitting element 30*a* and light receiving element 30*b* are positioned so that the infrared light is emitted by the light emitting element 30*a* at an angle of $\alpha$relative to a line perpendicular (normal) to the conveyer belt 11, is reflected by the surface of the conveyer belt 11 at the same angle as the angle at which it is projected, and is caught by the light receiving element 30*b*. Referring to FIG. 7, the developer image detection sensor 30 is disposed above the driver roller 13, with the provision of a predetermined distance from the conveyer belt 11. As the conveyer belt 11 is moved (in direction indicated by arrow mark Y in drawing), the developer image detection sensor 30 sequentially detects the developer image 31 having been transferred directly onto the conveyer belt 11. The developer image detection sensor 30 may be located in the direction perpendicular to the portion of the conveyer belt in the recording medium conveying range. Further, in terms of the direction in which the developer seal 46 is peeled, the developer image detection sensor 30 may be located on either side of the conveyer belt 11. In this embodiment, however, the developer image detection sensor 30 is located on the side having the winding shaft 54 (right-hand side in FIG. 7), that is, the downstream side. Positioning the developer image detection sensor 30 as describing above ensures that it is correctly determined whether or not the developer seal 46 has been properly wound up.

(Control System of Image Forming Apparatus)

Next, referring to FIG. 8, which is a block diagram, the control system of the image forming apparatus in this embodiment will be described.

The engine controller 61 of the image forming apparatus, which controls the overall operation of the image forming apparatus, comprises an unshown central processing unit (CPU). The image forming sequence of the image forming apparatus is carried out in accordance with the programs stored in advance in the central processing unit (CPU). The high voltage power source 62 provides charge bias, development bias, and transfer bias, for each color, along with the fixation bias. The charge bias is the DC voltage to be applied to the charging member 2 as a charging means. The development bias is the DC voltage to be applied to the development roller 40 as a developing means. The transfer bias is the DC voltage to be applied to the transfer roller 12 as a transferring means. Further, the fixation bias is the DC voltage to be applied to the fixing means 20. Within the main assembly 100, a group of sensors 63 inclusive of the developer image detection sensor 30 are disposed. Further, the apparatus main assembly 100 is provided with a display portion 64 which shows the conditions of the image forming apparatus. It is also provided with a driving portion 66 inclusive of the abovementioned driving means D (FIG. 3).

(Process Cartridge Readiness Determination Sequence)

Figure 8:
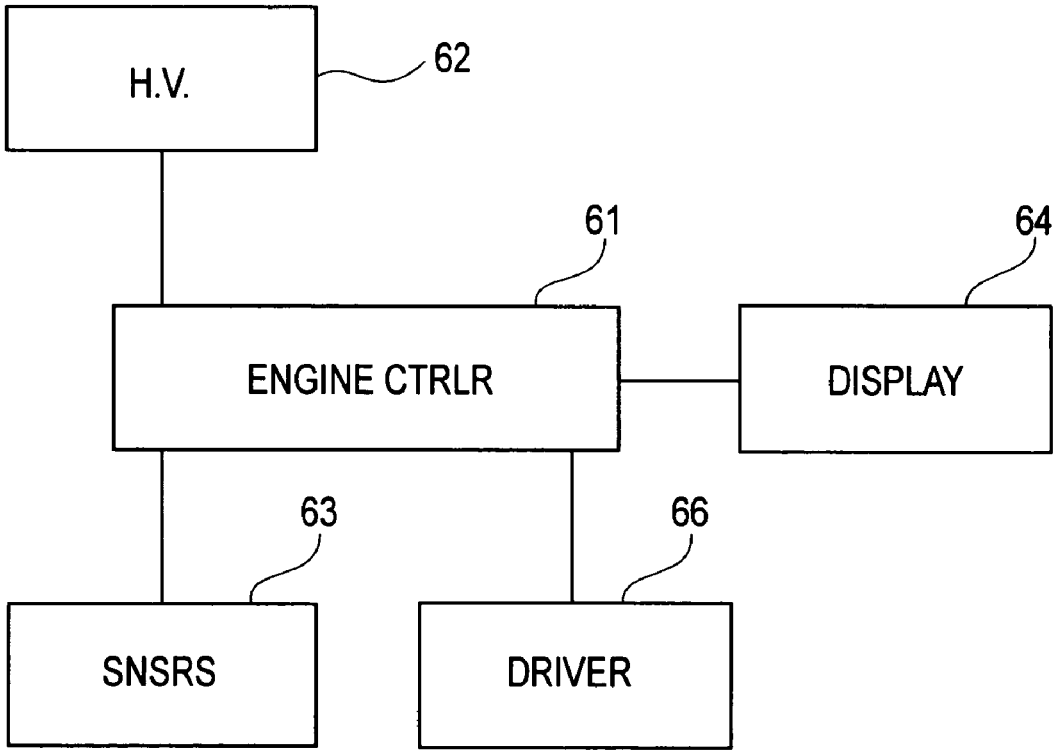
FIG. 8 is a block diagram of the control system of the main assembly of the image forming apparatus in the first embodiment of the present invention.
Figure 9A:
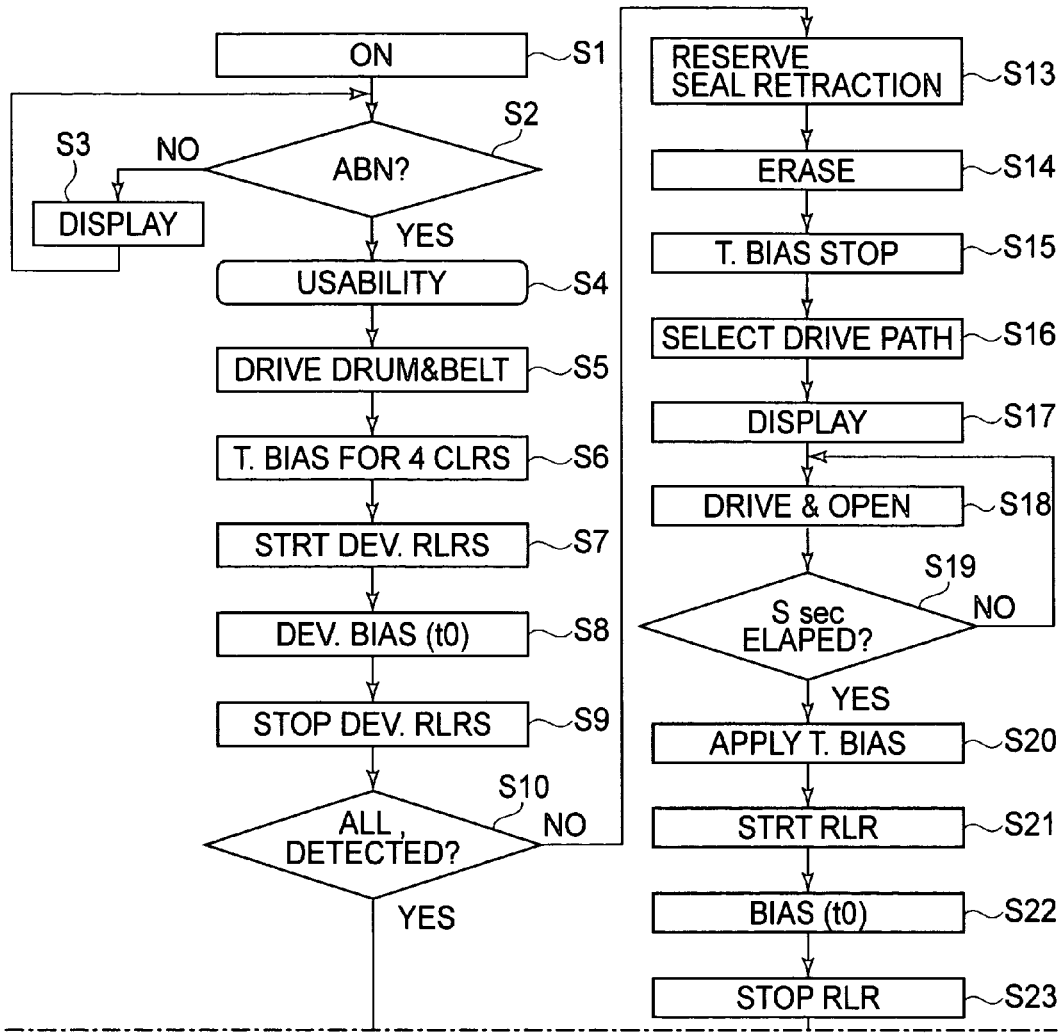
FIG. 9 is a flowchart of the sealing member winding operation in the first embodiment of the present invention.
Figure 9B:
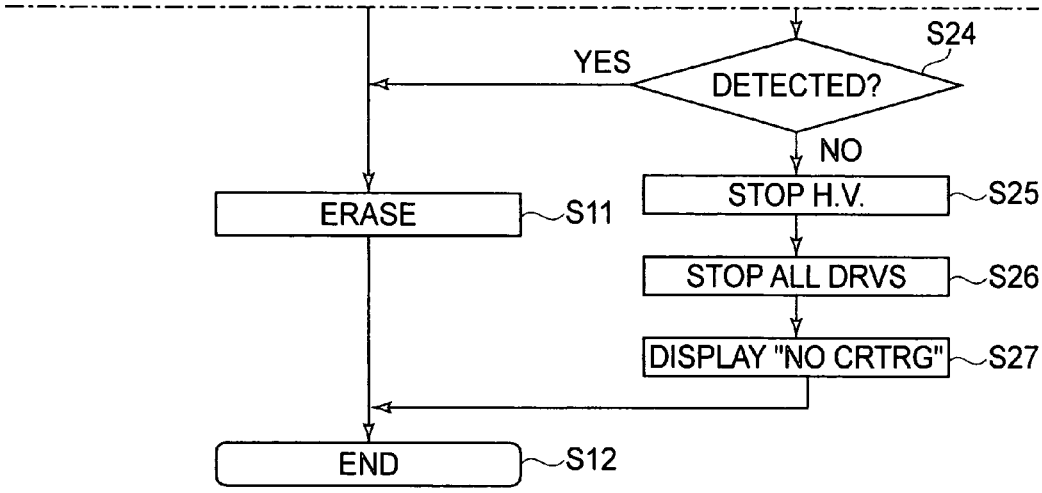
Figure 9:
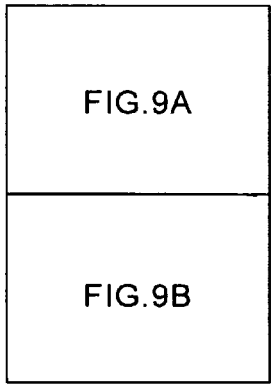

Referring to the block diagram in FIG. 8 and the flowchart in FIG. 9, the sequence carried out after the mounting of the process cartridge 7 into the main assembly 100 of the image forming apparatus, in order to determine whether the developer seal 46 of the process cartridge 7 is still covering the opening 41*e*, that is, the developer supply passage, preventing therefore the cartridge 7 from being used for image formation, or the developer seal 46 has been removed (separated) from the opening 41*e*, readying the process cartridge 7 for image formation.

As the electric power source of the apparatus main assembly 100 is turned on (S1), the engine controller 61 acquires information from the sensor portion 63, determining thereby whether or not the apparatus is in the abnormal condition (S2). For example, if such anomalies that a recording medium (transfer medium) S is stuck (jammed condition) in the apparatus main assembly 100 is detected, or that the processing units have not properly engaged with the apparatus main assembly 100 (for example, door is open), the engine controller 61 displays the anomaly information on the display portion 64 (S3), and keeps the apparatus on standby until the apparatus is cleared of the anomaly.

When no anomaly is detected, the engine controller 61 advances to the step in which it determines whether or not the developer seal 46 is still remaining covering the opening 41*e*, in other words, whether or not the process cartridge is ready for image formation (S4).

It cannot be determined whether the process cartridge was mounted into the apparatus main assembly while the power source was off, or the process cartridge 7 was mounted while the door was open. Therefore, it is desired that whether or not the process cartridge 7 is ready for image formation is determined at this point in the operational sequence.

Then, the engine controller 61 begins driving the conveyer belt 11 and all the photosensitive drums 1*a*, 1*b*, 1*c*, and 1*d* (S5) correspondent to the four color components, one for one, and instructs the high voltage power source 62 to begin applying to all the transfer rollers 12*a*, 12*b*, 12*c*, and 12*d* correspondent to the four color components, one for one, the transfer voltage for transferring developer images onto the transfer belt 11 (S6).

Next, the engine controller 61 instructs the driving portion 66 to begin driving all the development rollers 40*a*, 40*b*, 40*c*, and 40*d* correspondent to the four color components, one for one (S7). At the same time, it instructs the high voltage power source 62 to apply development bias (DC voltage) to the development rollers 40*a*, 40*b*, 40*c*, and 40*c* correspondent to the color components, one for one, for a predetermined length t0 (seconds) of time (S8). This predetermined length of time t0 has only to be long enough to form a developer image wide enough to be detectable by the developer image detection sensor 30. The developer image detection sensor 30 in this embodiment can detect a developer image as long as the developer image is no less than 3 mm in width. Therefore, the length of time t0 the development bias is to be applied is set to 0.035 second. In this step, the photosensitive drums 1 have not been uniformly charged by the charge rollers 2, being therefore nonuniform in surface potential level. However, the development bias voltage is set to a value equivalent to the potential level (Vd) of the unexposed portion of the peripheral surface of the photosensitive drum 1 in the normal image formation process, so that while this development bias is applied, the developer having been supplied to the development roller 40 from within the developer container 41 is transferred onto the peripheral surface of the photosensitive drum 1, forming a developer image, the density of which is equivalent to that of fog.

Then, immediately after the application of the development bias for the predetermined length t0 of time, the engine controller 61 stops driving of the development rollers 40*a*, 40*b*, 40*c*, and 40*d* correspondent to the four color components, one for one, (S9), preventing thereby the unnecessary reduction of the service life of the development unit.

With the application of the above described development bias, a developer image 31 is formed on each photosensitive drum 1. This developer image 31 is transferred onto the conveyer belt 11, which is being driven. The conveyer belt 11 is continuously driven after the transfer of the developer image 31 onto the conveyer belt 11, and therefore, the developer image 31 is moved below the developer image detection sensor 30 disposed above the driver roller 13. The distance, in the main assembly of the image forming apparatus, from each of the developing portions in which a latent image is developed by one of the four developers different in color, to the transfer portion, and the distance, in the main assembly of the image forming apparatus, from each of the transfer portions in which an image formed of one of the four developers different in color is transferred onto the conveyer belt 11 (transfer medium), are predetermined. Therefore, the points T(1), T(2), T(3), and T(4) in time at which the four developer images 31 different in color, which are moved at the predetermined velocity (94.2 mm in this embodiment), pass by the developer image detection sensor 30, can be easily obtained by calculating the length of time which has elapsed since the application of the aforementioned development bias.

Figure 10:
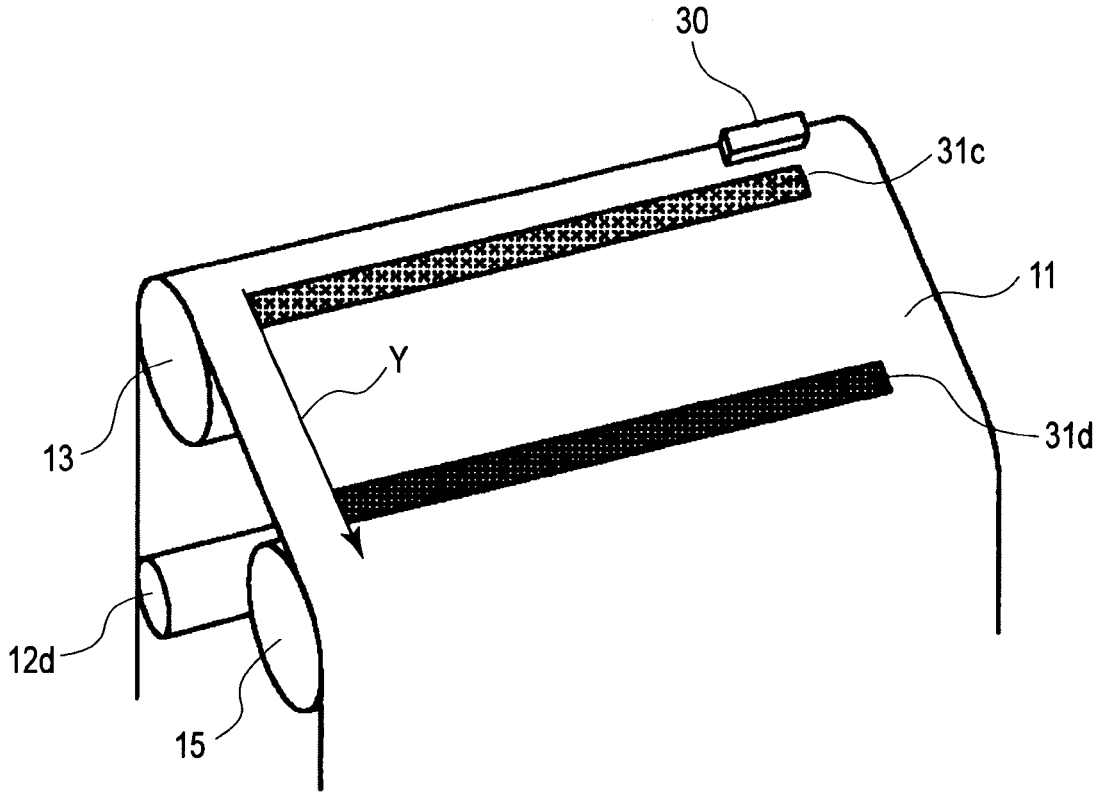
FIG. 10 is a perspective view of the developer image detecting means in the first embodiment, depicting the process of developer image detection.

FIG. 10 is a schematic drawing of the developer image detection sensor 30 and its adjacencies. The abovementioned development bias is applied to the development rollers 40 for first to fourth colors at the same time. Therefore, the order in which the developer images different in color pass by the developer image detection sensor 30 becomes the developer images of the fourth, third, second, and first colors. FIG. 10 depicts the developer image detection sensor 30 and its adjacencies at the point in time when the developer image 31*d*, that is, the developer image of the fourth color, had already passed by the developer image detection sensor 30, and the developer image 31*c*, or the developer image of the third color, has just passed the developer image detection sensor 30. The chronological changes in the magnitude of the output of the sensor 30 sent to the engine controller 61 are shown in FIG. 11.

Figure 11:
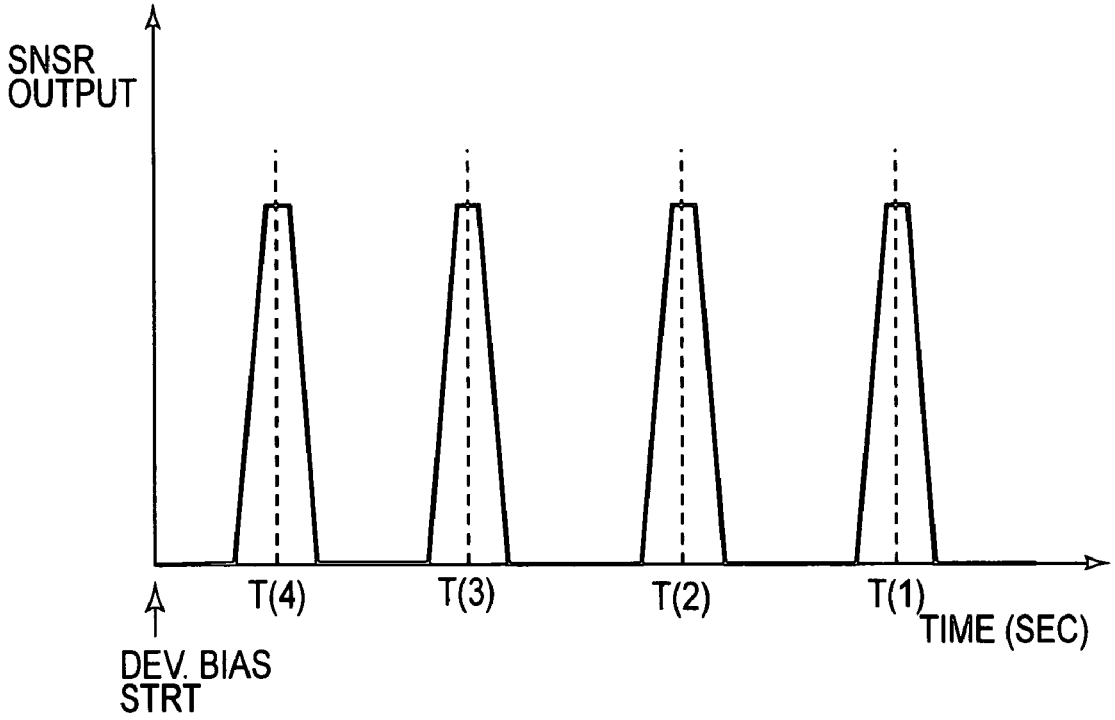
FIG. 11 is a graph showing the relationship between the magnitude of the output of the developer image detection sensor, and the elapse of time, in the first embodiment of the present invention.

The horizontal axis of the graph in FIG. 11 represents the length of the time (seconds) which elapsed from the beginning of the application of the development bias voltage, and the vertical axis represents the magnitude of the output of the developer image detection sensor 30. As will be evident from FIG. 11, the value of the output of the sensor spikes at T(4), T(3), T(2), and T(1), that is, the times when the four developer images pass by the developer image detection sensor 30 seriatim.

Figure 12:
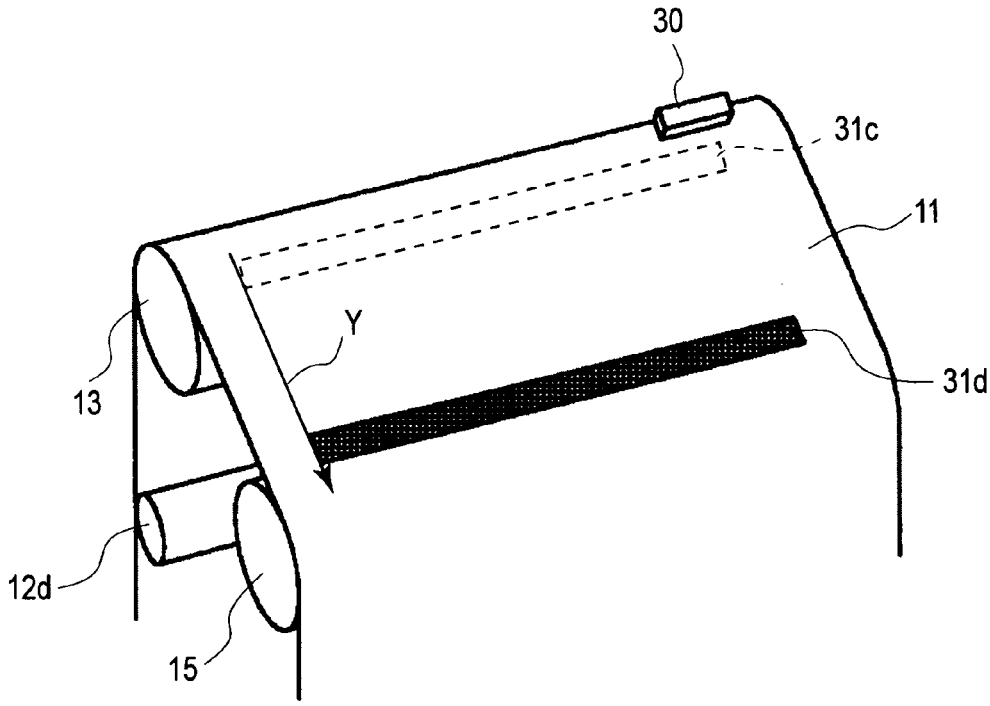
FIG. 12 is a perspective view of the developer image detecting means in another embodiment of the present invention, depicting the process of developer image detection.
Figure 13:
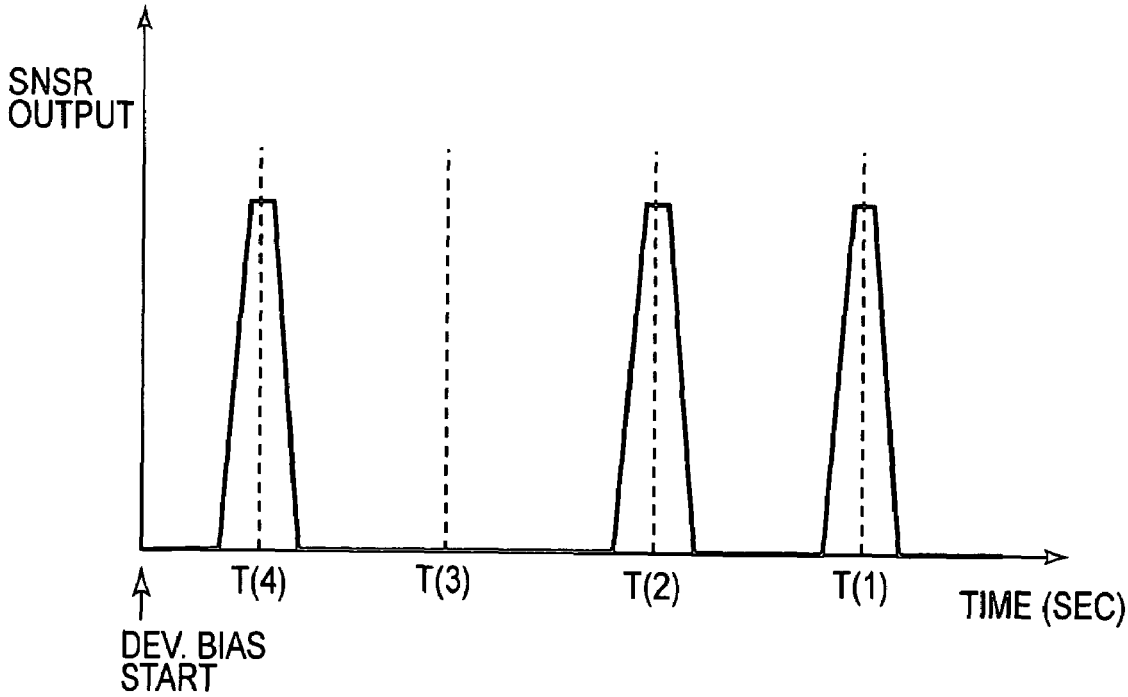
FIG. 13 is a graph showing the relationship between the magnitude of the developer image detection sensor, and the elapse of time, in another embodiment of the present invention.

However, there are situations in which the application of the development bias does not yield any developer image, for example, the situation in which no developer is borne on the development rollers 40 because the developer seal 46 is still covering the developer supply opening 41*e*, and therefore, the process cartridge 7 is not usable for image formation, or the like situation. Referring to FIG. 12, if the process cartridge 7 for the third color, for example, is unusable, there will be no developer image across the portion of the conveyer belt 11, across which the developer image 3*d*, or the developer image of the third color, would have been formed. Further, no output will be sent from the developer image detection sensor 30 to the engine controller 61 at T(3), that is, the time when the developer image d3 would have been detected, as shown in FIG. 13. Therefore, it can be determined that there is the possibility that the process cartridge for the third color might be not usable for image formation.

As described above, the engine controller 61 uses the output of the developer image detection sensor 30 to determine whether the process cartridges 7 are ready for usage, or the developer seal 46 of any of the process cartridges 7 is still covering the opening 41*e*, keeping thereby the process cartridge 7 unusable for image formation (S10).

As soon as it is determined that all the process cartridges 7 are ready for image formation, the engine controller 61 displays on the display portion 64 that all the process cartridges 7 are ready for image formation, and carries out the cleaning operation for erasing the developer images 31*a*, 31*b*, 31*c*, and 31*d* on the conveyer belt 11 (S11). Then, it ends the process of determining whether or not the process cartridges 7 are in the usable condition (S12). By carrying out the above described operational sequence, it is possible to discriminate the process cartridge 7 ready for image formation, that is, the process cartridge 7, the developer seal 46 of which has been removed, from the process cartridge 7, the developer supply opening 41*e* of which is still sealed with the developer seal 46.

As for the belt cleaning operation, in this embodiment, such voltage that is opposite in polarity to the transfer voltage is applied to the transfer roller 12 (12*a*, 12*b*, 12*c*, and 12*d*) to return the developer images 31*a*, 31*b*, 31*c*, and 31*d* on the conveyer belt 11 to the cleaning portion. Obviously, a belt cleaning apparatus 70 (FIG. 1) for the conveyer belt 11 may be disposed on the downstream side of the developer image detection sensor 30 to remove the developer images on the conveyer belt 11.

When determining whether the process cartridges 7 are ready for usage, or they are not ready for usage, that is, there is the possibility that the developer seal 46 has not been removed (separated) (S10), there are situations in which there is no output from the developer image detection sensor 30 as depicted in FIG. 13. The above described situation in which there was no output from the developer image detection sensor 30 when the developer image 3*c*, or the developer image of the third color, was passing by the developer image detection sensor 30 is one of such situations. In such a situation, the engine controller 61 determines that there is an unusable process cartridge in the apparatus main assembly 100, and schedules the operation for retracting the developer seal 46 of the process cartridge 7 (S13). In this embodiment, the schedule is made for the process cartridge 7 for the third color. Thereafter, the developer images are erased by carrying out the belt cleaning operation (S14), and the application of the transfer bias voltage is stopped (S15).

As it is recognized that there is an unusable process cartridge 7, that is, a process cartridge the developer seal 46 of which has not been removed or separated, in the main assembly 100 of the image forming apparatus, the developer supply opening 41*e* of the developer container 41 is to be exposed. In order to expose the opening 41*e*, the engine controller 61 issues to the driving means D the signal for removing the developer seal 46, and the driving force is transmitted to the process cartridge 7 from the driving means D.

In this step, the driving force from the motor 101 of the image forming apparatus main assembly 100 is transmitted to the clutch CL through the driving gear train. The clutch CL is an electromagnetic clutch, for example. The engine controller 61 of the image forming apparatus main assembly 100 makes the clutch CL transmit the driving force to the driving gear train located further downstream of the motor 101, and the process cartridge 7, or not to transmit the driving force thereto, letting the motor 101 idle.

By carrying out the above described operational sequence, that is, by transmitting the driving force from the motor 101 of the image forming apparatus main assembly 100 to the process cartridges 7, it is possible to automatically expose the developer supply opening 41*e*. In particular, the provision of the clutching mechanism (CL) makes it possible to selectively transmit the driving force to the process cartridges 7, that is, to transmit the driving force only to the unusable process cartridge(s) 7 in the image forming apparatus main assembly 100.

With the employment of the above described structural arrangement and operational sequence, the driving force can be transmitted only to the development unit(s) the sealing member(s) of which are still covering the developer supply opening 41*e*, to automatically remove the developer seals 46, which have not been removed, whether a single or plurality of development units are mounted in an image forming apparatus employing a plurality of development units. Therefore, it does not occur that the service life of each development unit is reduced by the length longer than necessary.

Next, referring to FIG. 9, the rest of the above described operation sequence, that is, the portion of the operational sequence for transmitting the driving force only to the unusable process cartridge(s), that is, the process cartridge(s) the developer seal of which has not been removed (separated), will be described.

In order to transmit the driving force from the image forming apparatus main assembly 100 only to the process cartridge(s), the developer seal 46 of which has been determined by the engine controller 61 to be still covering the developer supply opening 41*e*, the driving force transmission route is selected by the engine controller 61 (S16). In this step, the engine controller 61 makes the display portion 64 display the information (message) that the unprepared process cartridge(s), that is, the process cartridge (c) the developer seal 46 of which has not been removed, is being initialized (S17).

Referring to FIG. 3, as the driving force is transmitted to the process cartridge(s) 7 by driving the driving force source, for example, the motor 101, of the image forming apparatus main assembly 100, the driving force is transmitted to the driving gear train of the process cartridge(s) 7. Then, from the driving gear train, the driving force is transmitted to the winding shaft 54 through the developer supply roller 43, which in turn retracts the developer seal 46, exposing thereby the developer supply opening 41*e* of the developer container 41 (S18). In this step, the driving force is continuously inputted for a predetermined length S (seconds) of time to ensure that the developer seal 46 is completely retracted to fully expose the opening 41*e* (S19).

The actually measured length of time necessary to completely remove the developer seal 46, that is, the length of time necessary to completely wind the developer seal 46, was roughly 20 seconds. In this embodiment, therefore, the predetermined length S of time is set to 20 seconds. After the elapse of the predetermined length S of time, the engine controller 61 carries out the above described steps (S6)-(S9) of the operational sequence, only for the process cartridge (s), the developer seals 46 of which was determined by the engine controller 61 to be still covering the developer supply opening. In other words, the engine controller 61 applies the transfer bias voltage for the process cartridge(s), the developer seal 46 of which has just been removed (S20). Then, it drives the development roller 40 (S21). Then, it applies the development bias for t0 seconds (S22). Then, it stops the driving of the development roller 40 (S23). In this embodiment, it was detected that the process cartridge for the third color was the process cartridge, the developer seal 46 of which had not been removed. Therefore, the above described steps (S20)-(S23) were carried out only for the process cartridge for the third color.

Figure 14:
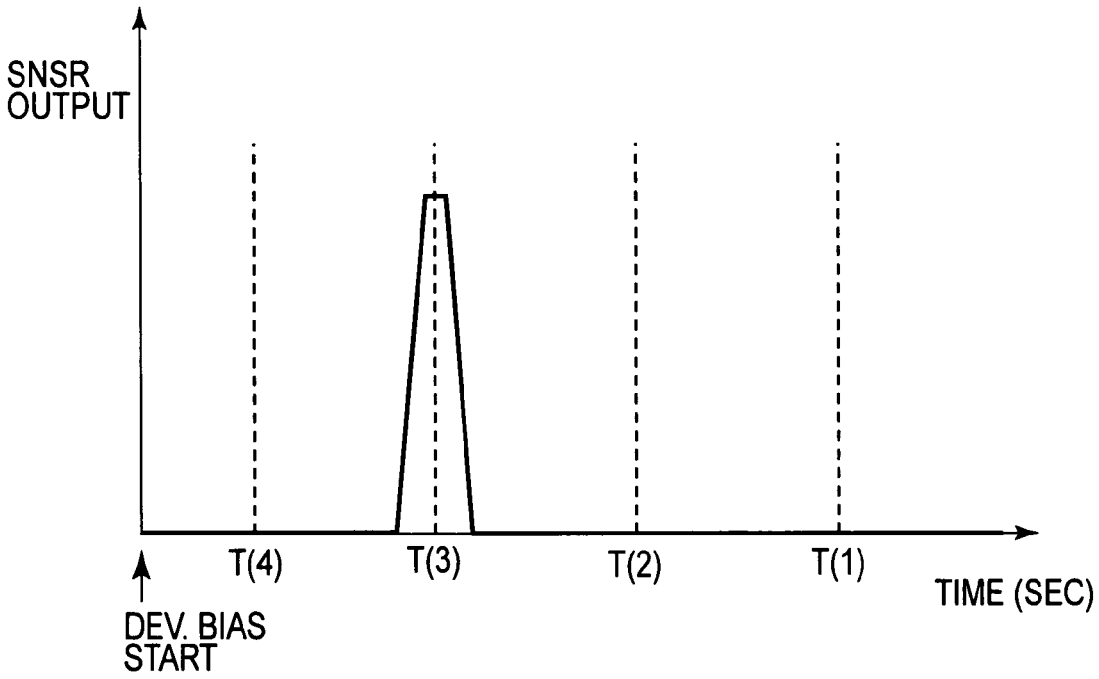
FIG. 14 is a graph showing the relationship between the magnitude of the developer image detection sensor, and the elapse of time, in another embodiment.

Thereafter, it is determined whether or not a developer image, correspondent in color to the process cartridge whose developer seal 46 is supposed to have just been removed (S24), was detected by the developer image detection sensor 30. If the developer image, correspondent in color to the process cartridge whose developer seal 46 is supposed to have just been removed, was detected by the developer image detection sensor 30, the engine controller 61 changes the information on the display portion 64 to the information that the suspected process cartridge(s) has become ready for image formation, and carries out the operation for erasing the developer image(s) on the conveyer belt 11 (S11). Then, it ends the process cartridge readiness determination sequence, that is, the operational sequence for determining whether or not the process cartridges 7 are ready for image formation (S12). In this embodiment, the above described steps (S20)-(S23) were carried out, assuming that the process cartridge 7 for the third color might be not ready for image formation. Thus, as it was determined in step (S24) whether or not the developer seal 46 of the suspected process cartridge 7 been removed, the changes in magnitude of the output of the developer image detection sensor 30 became as shown in FIG. 14, in which there was an output from the developer image detection sensor 30 at T(3), that is, the point in time when the developer image of the third color passed by the developer image detection sensor 30, as shown in FIG. 14. As a result, it is determined that the developer seal 46 of the suspected process cartridge 7 had been retracted, and the process cartridge 7 is ready for image formation.

It should be noted here that even after the removal of the developer seal 46 of the suspected process cartridge 7, there is sometimes no output from the developer image detection sensor 30 when the developer image formed of the developer from the suspect process cartridge 7 is passing by the developer image detection sensor 30. Such an occurrence is possible when the cartridge compartment for the suspect process cartridge 7 is empty (no process cartridge was mounted in cartridge compartment), or when the developer container 41 of the suspect process cartridge 7 has been depleted of developer. Such an occurrence is also possible when the developer seal 46 could not be retracted due to the anomaly such as mechanical troubles or the like. In such a case, the engine controller 61 turns off the high voltage power source (S25), and also, makes the driving portion 66 stop outputting (transmitting) the driving force (S26). Then, it displays on the display portion 64 the information regarding the anomaly, for example, that there is no process cartridge in the cartridge compartment for the suspected process cartridge 7 (S27). Then, it ends the process cartridge readiness determination sequence (S12).

The above described method, in this embodiment, for determining whether or not the process cartridges 7 are ready for image formation is usable even if the developer images for determining whether or not the process cartridges 7 are ready for image formation are formed through an image formation process identical to the normal image formation process.

In other words, after the starting of the rotational driving of the photosensitive drums 1 (S5), the engine controller 61 activates the high voltage power source 62 so that the charge bias voltage is applied to the charge rollers 2. Then, immediately before the development bias is applied (S8), electrostatic images of the minimum size detectable by the developer image detection sensor 30, such as those shown in FIG. 7, are formed through the exposure by the scanner units 3. Even if this method is used for the formation of the electrostatic latent images for determining whether or not the process cartridges 7 are ready for image formation, whether or not the process cartridges 7 are ready for image formation can be determined as it is in this embodiment. In addition, this method can minimize the amount of the developer consumed for the formation of the developer images during the process cartridge readiness determination sequence.

Further, in this embodiment, the photosensitive drums 1 and conveyer belt 11 are continuously driven until the end of the process for determining whether or not all the process cartridges are ready for image formation, that is, whether or not the developer seal 46 has been removed from all the process cartridges 7. However, after the erasing of the developer images (S14), the rotation of the photosensitive drums 1 and movement of the conveyer belt 11 may be temporarily suspended at the same time as the application of the transfer bias (S15) is stopped, and then, be restarted immediately before applying the transfer bias to the suspected process cartridge(s) 7 (S20). Such an operational sequence yields the same conclusions as those made in this embodiment. Moreover, such an operational sequence minimizes the wear of the photosensitive drums 1 and conveyer belt 11 attributable to the above described operational sequence in this embodiment.

In the above, this embodiment was described with reference to the case in which only one process cartridge 7 in the apparatus main assembly 100 was not ready for image formation. However, the above described method for determining whether or not the process cartridges are ready for image formation is also effective when two or more process cartridges 7 are not ready for image formation. Regarding the establishment of the driving force transmission routes to the suspected process cartridges 7 (S16), the image forming apparatus may be structured so that all the driving force transmission routes to the suspected process cartridges 7 are established at the same time, or the driving force transmission routes to the suspected process cartridges 7 are sequentially established, that is, the portion of the operational sequence comprising the steps (S16)-(S19) is sequentially carried out for each of the suspected process cartridges 7. In this embodiment, the image forming apparatus is structured so that all the driving force transmission routes to the suspected process cartridges 7 are established at the same time, because such a structural arrangement is advantageous in that it reduce the processing time.

The structural arrangement in this embodiment makes it unnecessary to provide the image forming apparatus with the electrical contacts for determining whether or not the developer seal 46 has been retracted from the developer supply opening 41*e*. Thus, it can prevent the cost increase attributable to the electrical contacts with which the image forming apparatus main assembly as well as the process cartridge must be provided if the image forming apparatus is structured otherwise, and also, the increase in the number of the components associated with the provision of the above-mentioned electrical contacts.

Embodiment 2

Next, the method, in another embodiment of the present invention, for detecting whether or not the process cartridges in the image forming apparatus are ready for image formation will be described. Also in this embodiment, the same image forming apparatus main assembly 100 and process cartridges 7 as those used in the first embodiment described with reference to FIGS. 1-5 are used. Therefore, the apparatus main assembly 100, process cartridges 7, and system structure, of this image forming apparatus will not be described, and only the cartridge readiness detecting means which characterizes this embodiment will be described.

(Developer Image Detection Sensor Portion)

Figure 15:
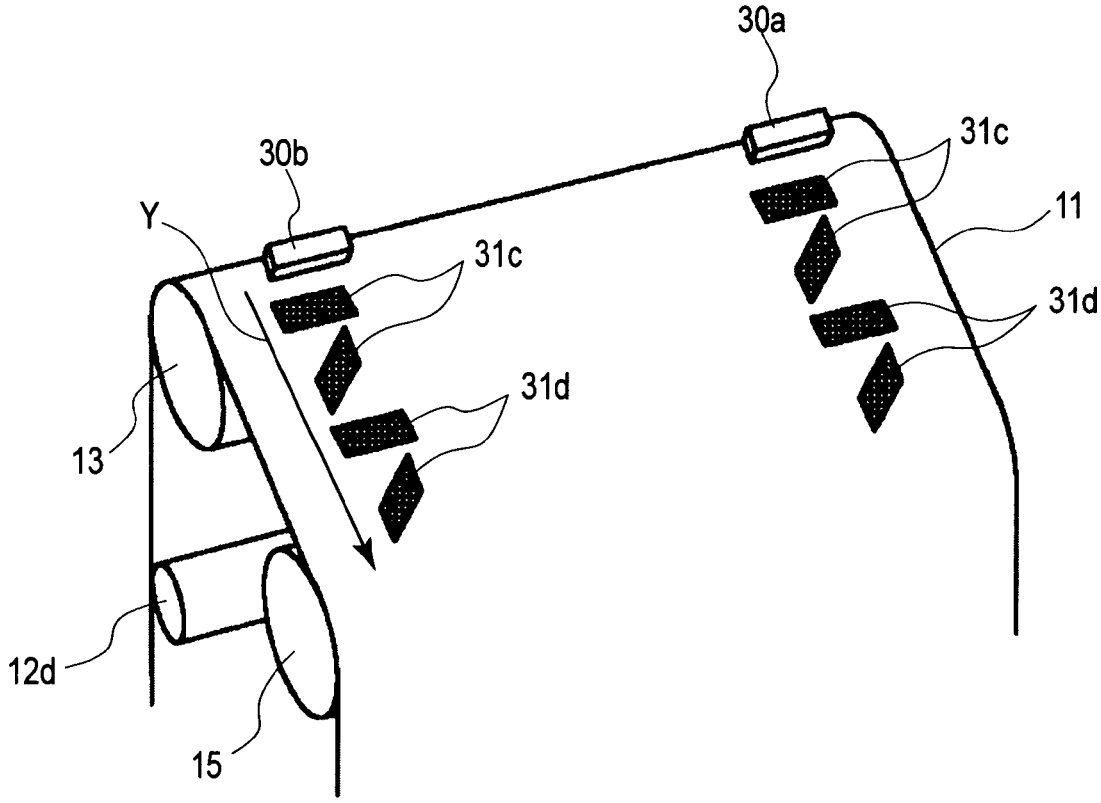
FIG. 15 is a perspective view of the developer image detecting means in another embodiment, depicting the process of developer image detection.

FIG. 15 is a schematic drawing of the developer image detection sensor 30 (30*a* and 30*b*) in this embodiment. As described above, the image forming apparatus is not uniform in terms of the relationship, in the velocity at the transfer point, between the peripheral surface of the photosensitive drum 1 and conveyer belt, because the plurality of photosensitive drums are not always uniform in peripheral velocity, sometimes fluctuate in peripheral velocity, and/or the conveyer belt also fluctuate in velocity. In such a situation, color deviation occurs, which is the phenomenon that when a plurality of developer images different in color are sequentially placed in layers, they do not perfectly align. FIG. 15 shows the developer images (31*c* and 31*d* in FIG. 15) formed as registration marks in order to control the color deviation.

As shown in FIG. 15, the developer image detection sensors 30*a* and 30*b* are disposed above the left and right ends of the driver roller 13, with the provision of a predetermined distance between the two sensors 30*a* and 30*b* and the conveyer belt 11. As the conveyer belt 11 is moved (in direction indicated by arrow mark Y in FIG. 15), the sensors 30*a* and 30*b* sequentially detect the corresponding developer images 31 having been just transferred directly onto the conveyer belt 11. In this embodiment, whether or not the process cartridges 7 are ready for image formation is detected by these two developer image detection sensors 30*a* and 30*b*.

The sensor 30*a* is disposed near one of the edges of the conveyer belt 11, on the downstream side of the developer seal 46 in terms of the direction in which the developer seal 46 is peeled, that is, the side where the winding shaft 54 is located (right-hand side in FIG. 15), whereas the sensor 30*b* is disposed near the other edge of the conveyer belt 11, on the upstream side of the developer seal 46, that is, the side where the exposure of the developer supply opening 41*e* of the developer container 41 begins (left-hand side in FIG. 15). The developer image detection sensors 30*a* and 30*b* disposed as described above are integral parts of the sensor portion 63 of the block diagram of the control system in this embodiment, shown in FIG. 16.

(Cartridge Readiness Determination Sequence)

Figure 16:
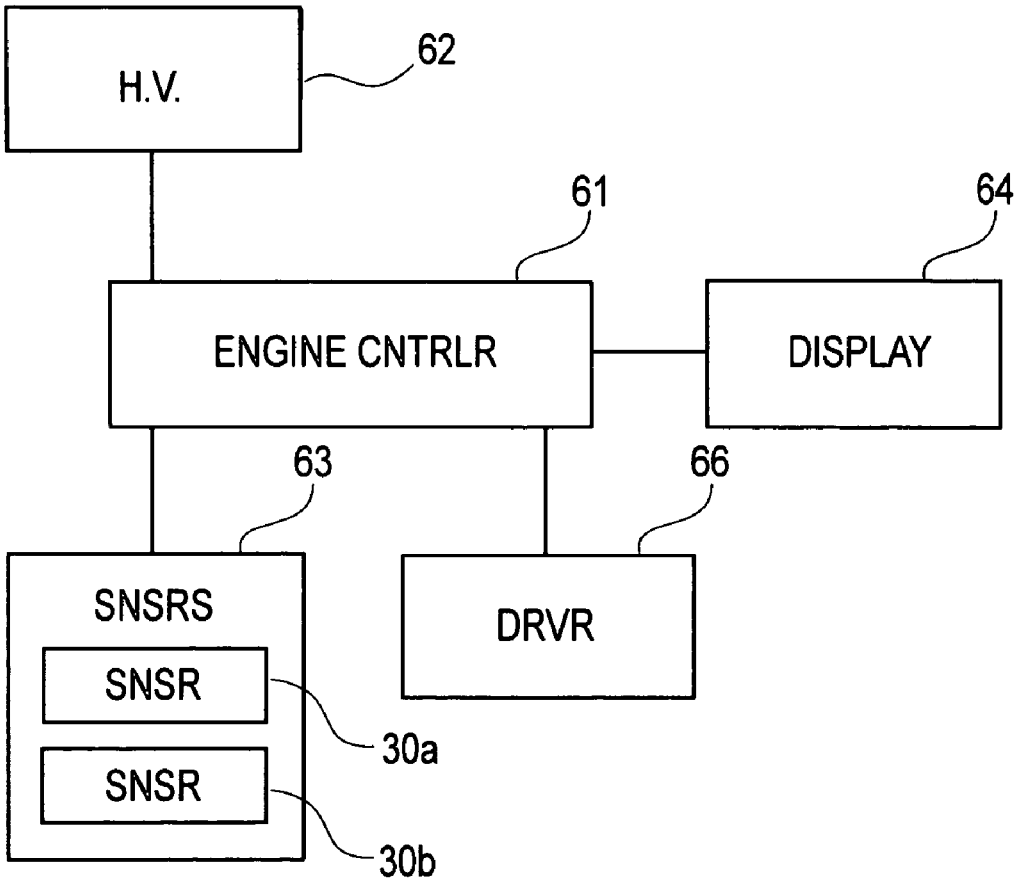
FIG. 16 is a block diagram of the control system of the main assembly of the image forming apparatus in another embodiment of the present invention.
Figure 17A:
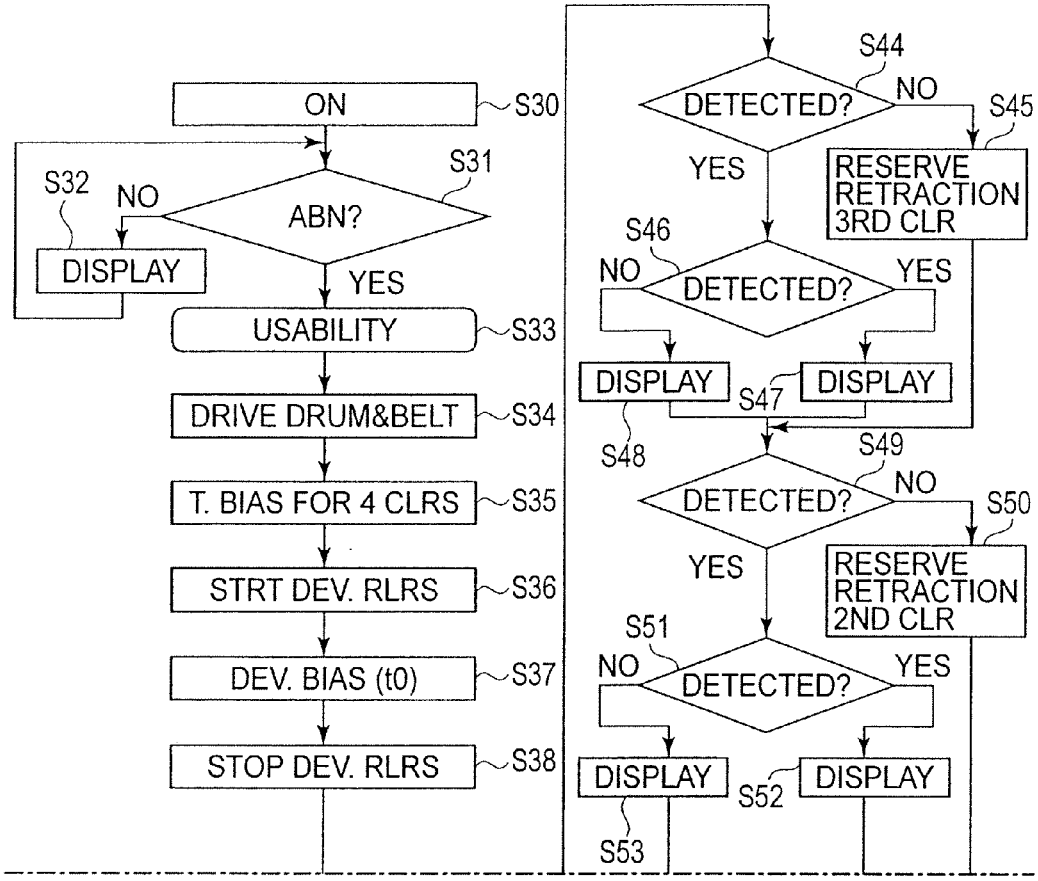
FIG. 17 is a flowchart of the sealing member winding operation in the first embodiment of the present invention.
Figure 17B:
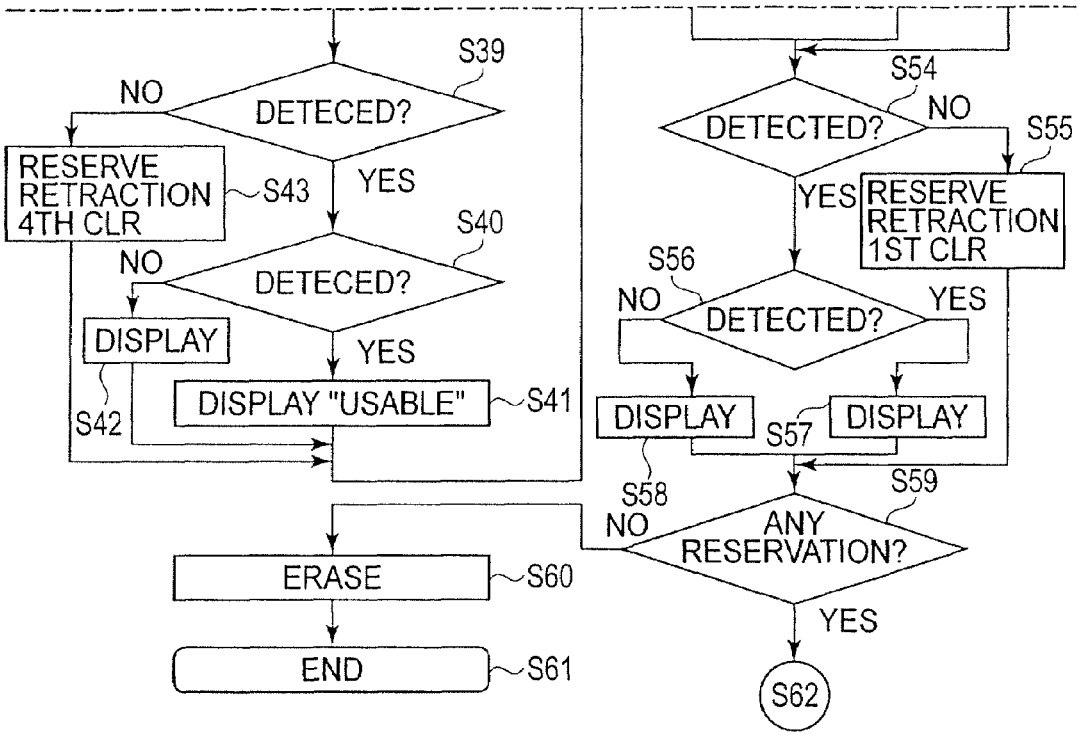
Figure 17:
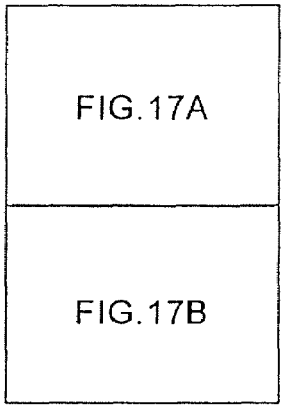

Next, referring to the block diagram in FIG. 16 and flowchart in FIG. 17, the operational sequence carried out after the insertion of the process cartridge 7 into the main assembly 100 of the image forming apparatus, in order to determine whether or not the process cartridges 7 are ready for developer usage will be described. Here, that a process cartridge is in the unusable condition means that the developer seal 46 is still covering the developer supply opening 41*e*, whereas that a process cartridge is in the usable condition means that the developer seal 46 has been removed (separated) from the developer supply opening 41*e*.

As the electric power source of the apparatus main assembly 100 is turned on (S30), the engine controller acquires information from the sensor portion 63, determining thereby whether or not the apparatus is in the abnormal condition (S31). For example, if such anomaly that there is a recording medium (transfer medium) S stuck (jammed condition) in the apparatus main assembly 100, or the processing units have not properly engaged with the apparatus main assembly 100 (for example, door is open), is detected, the engine controller 61 displays the anomaly information on the display portion 64 (S32), and keeps the apparatus on standby until the apparatus is cleared of the anomaly.

When no anomaly is detected, the engine controller 61 advances to the step in which it determines whether or not the process cartridges are ready for image formation (S33).

It cannot be determined whether the process cartridge was mounted into the apparatus main assembly while the power source was off, or the process cartridge 7 was mounted while the door was open. Therefore, it is preferable that whether or not the process cartridge 7 is ready for image formation is determined at this point in the operational sequence.

Then, the engine controller 61 causes the driving portion to begin driving the conveyer belt 11 and all the photosensitive drums 1*a*, 1*b*, 1*c*, and 1*d* correspondent to the four color components, one for one (S34), and instructs the high voltage power source 62 to begin applying to all the transfer rollers 12*a*, 12*b*, 12*c*, and 12*d* correspondent to the four color components, one for one, the transfer voltage for transferring developer images onto the transfer belt 11 (S35).

Next, the engine controller 61 instructs the driving portion 66 to begin driving all the development rollers 40*a*, 40*b*, 40*c*, and 40*d* correspondent to the four color components, one for one (S36). At the same time, it instructs the high voltage power source 62 to apply development bias (DC voltage)to the development rollers 40*a*, 40*b*, 40*c*, and 40*c* correspondent to the four color components, one for one, for a predetermined length t0 (seconds) of time (S37). This predetermined length of time t0 has only to be long enough to form a developer image wide enough to be detectable by the developer image detection sensors 30*a* and 30*b*. The developer image detection sensors 30*a* and 30*b* in this embodiment can detect a developer image as long as the developer image is no less than 3 mm in width. Therefore, the length of time t0 the development bias is to be applied is set to 0.035 second. In this step, the photosensitive drums 1 have not been uniformly charged by the charge rollers 2, being therefore nonuniform in surface potential level. However, the development bias voltage is set to a value equivalent to the potential level (Vd) of the unexposed portion of the peripheral surface of the photosensitive drum 1 in the normal image formation process, so that while this development bias is applied, the developer having been supplied to the development roller 40 from within the developer container 41 is transfeffed onto the peripheral surface of the photosensitive drum 1, forming a developer image, the density of which is equivalent to that of fog.

In order to prevent the service life of the development unit from being unnecessarily reduced, the engine controller 61 stops driving of the development rollers 40*a*, 40*b*, 40*c*, and 40*d* correspondent to the four color components, one for one, immediately after the application of the development bias for the predetermined length t0 of time (S38).

With the application of the above described development bias, developer images 31 are formed on each photosensitive drum 1. This developer images 31 are transferred onto the conveyer belt 11, which is being driven. The conveyer belt 11 is continuously driven after the transfer of the developer images 31 onto the conveyer belt 11, and therefore, the developer images 31 pass by the developer image detection sensor 30 disposed above the driver roller 13. The developer images 31 formed on the peripheral surface of the photosensitive drum 1 are transferred by the transfer bias onto the conveyer belt 11. Therefore, it does not occur that the developer images peel from the photosensitive drum 1 or conveyer belt 11, ensuring the developer image detection. This matter also applies to the first embodiment.

The distance, in the main assembly of the image forming apparatus, from each of the developing portions in which a latent image is developed by one of the four developer different in color, to the transfer portion, and the distance, in the main assembly of the image forming apparatus, from each of the transfer portions in which an image formed of one of the four developers different in color is transferred onto the conveyer belt 11 (transfer medium), are predetermined. Therefore, the points T(1), T(2), T(3), and T(4) in time at which the four developer images 31 different in color, which are moved at the predetermined velocity (94.2 mm in this embodiment), pass by the developer image detection sensor 30, can be easily obtained by calculating the length of time which has elapsed since the application of the aforementioned development bias.

The engine controller 61 determines, based on the outputs of the developer image detection sensors 30*a* and 30*b*, whether the process cartridges 7 are in the usable condition, or if there is the possibility that the developers in the process cartridges 7 are not currently available for image formation, with reference to the table given below.

The data regarding the presence and absence of the outputs from the developer image detection sensors 30*a* and 30*b* yield Results A-D given in Table 1.

TABLE 1

| Results | Snsr 30a | SnSr 30b | Process cartridge | Display |
|---|---|---|---|---|
| A | Y | Y | Operable | Operable |
| B | N | N | May be Inoperable | Initializing |
| C | N | Y | May be Inoperable | Initializing |
| D | Y | N | No Dvlpr Malfunc. | No Dvlpr |

That is, in the case of Result A, the developer seal 46 has already been retracted, and therefore, the process cartridge is in the usable condition. In the case of Result B, it is suspected that the developer seal 46 has not been retracted at all, and therefore, there is possibility that the process cartridge 7 may not be usable. Therefore, the image forming apparatus schedules the operation for retracting the developer seal 46. Result C is a case in which the developer image detection sensor 30*b* detected the developer image, but, the developer image detection sensor 30*a* did not detect the developer image. To describe this in more detail, the developer image detection sensor 30*b* is disposed near the upstream edge of the conveyer belt 11 in terms of the direction in which the developer seal 46 is peeled, that is, the side from which the developer supply opening 41*e* of the developer container 41 begins to be exposed, whereas the developer image detection sensor 30*a* is disposed near the downstream edge of the conveyer belt 11 in terms of the direction in which the developer seal 46 is retracted, that is, on the winding shaft 54 side of the conveyer belt 11. Thus, Result C indicates that the developer seal 46 begins to be retracted, but some kind of anomaly occurred before the developer seal 46 was completely retracted; for example, the developer seal 46 failed to be fully retracted because the power source of the image forming apparatus suddenly failed, or because the development unit had not been properly disposed in the apparatus main assembly, and therefore, the development unit became disengaged from the apparatus main assembly. In such a case, it is determined that the process cartridge is possibly in the unusable condition, and the operation for retracting the developer seal 46 is schedule, as it is in the case of Result B. In the case of Result D, the engine controller 61 does not determine that the process cartridge is in the unusable condition, and displays on the display portion 64 the warning that the process cartridge 7 is out of developer, or is suffering from mechanical and/or electrical trouble, or the like.

Next, referring to FIG. 17, the operational sequence carried out in response to the outputs of the two developer image detection sensors 30*a* and 30*b* will be described in detail.

First, the engine controller 61 acquires the data regarding whether or not there is output from the developer image detection sensor 30*a* when the portion of the conveyer belt 11, where the developer image of the fourth color is to be formed, passes by the sensor 30*a* (S39).

If the engine controller 61 detects the output from the developer image detection sensor 30*a*, it acquires the data regarding whether or not there is the output from the developer image detection sensor 30*b* when the portion of the conveyer belt 11, where the developer image of the fourth color is to be formed, passes by the sensor 30*b* (S40). If the engine controller 61 detects the output from the developer image detection sensor 30*b*, it determines that the process cartridge 7 for the fourth color is in the usable condition (Result A in Table 1), and displays the information that the process cartridge for the fourth color is ready for image formation (S41). If the developer image was not detected, it is determined that the process cartridge for the fourth color is depleted of developer (Result D in Table 1), and displays that the process cartridge for the fourth color is out of developer (S42). Then, the engine controller 61 moves onto the next step, that is, Step (S44) in which it is determined whether or not the process cartridge for the third color is in the usable condition.

If the developer image formed of the developer of the fourth color was not detected in step (S39), in which the engine controller 61 acquires the data regarding whether or not there is the output from the developer image detection sensor 30*a* when the portion of the conveyer belt 11, where the developer image of the fourth color is to be formed, passes by the sensor 30*a*, it is suspected that the process cartridge for the fourth color is in the condition which Result B or C in Table 1 indicates. Therefore, it is determined that the operation for retracting the developer seal 46 is necessary. Thus, the image forming apparatus schedules the operation for retracting the developer seal 46 of the process cartridge for the fourth color (S43). Then, the engine controller 61 advances to the next step, that is, Step (S44) in which it is determined whether or not the process cartridge for the third color is ready for image formation.

The operational sequence carried out to determine whether or not the process cartridge for the third color is in the usable condition is the same as that for the fourth color. In other words, it is determined whether or not there is the output from the developer image detection sensor 30*a* (S44). If no developer image is detected, the schedule is made for the operation for retracting the developer seal 46 (S45) of the process cartridge for the third color. If the developer image of the third color is detected, it is determined whether or not there is the output from the developer image detection sensor 30*b* (S46). Then, if the developer image is detected, it is displayed that the process cartridge for the third color is in the usable condition (S47), whereas if no developer image is detected, it is displayed that the process cartridge for the third color is out of developer (S48). Then, the engine controller 61 advances to Step (S49) in which it is determined whether or not the process cartridge for the second color is in the usable condition.

The operational sequence carried out to determine whether or not the process cartridge for the second color is in the usable condition is the same as those for the fourth and third colors. In other words, it is determined whether or not there is the output from the developer image detection sensor 30*a* (S49). If no developer image is detected, the engine controller 61 schedules the operation for retracting the developer seal 46 of the process cartridge for the second color (S50). If there is the developer image of the third color, the engine controller 61 determines whether or not there is the output from the developer image detection sensor 30*b* (S51). Then, if there is the developer image, the engine controller 61 displays that the process cartridge for the second color is in the usable condition (S52), whereas if there is no developer image, it displays that the process cartridge for the second color is out of developer (S53). Then, the engine controller 61 advances to Step (S54) in which it determines whether or not the process cartridge for the first color is in the usable condition.

After advancing to the step in which it is determined whether or not the process cartridge for the first color is ready for image formation, the engine controller 61 determines whether or not there is the output from the developer image detection sensor 30*a* (S54). if there is no developer image, the engine controller 61 schedules the operation for retracting the developer seal 46 of the process cartridge for the first color (S55). If there is the developer image of the first color, it determines whether or not there is the output from the developer image detection sensor 30*b* (S56). Then, if there is the developer image, it displays that the process cartridge for the first color is in the usable condition (S57), whereas if there is no developer image, it displays that the process cartridge for the first color is out of developer (S58).

After determining whether or not all the process cartridges are in the usable condition as described above, the engine controller 61 determines whether or not the process cartridge(s) for which the operation for retracting the developer seal is scheduled is actually present (S59). Then, if it determines that the suspected cartridge is nonexistent, it carries out the process for removing the developer image(s) on the conveyer belt 11 (S60), and ends the cartridge readiness determination sequence (S61). If it is determined, in Step (S59) in which the engine controller 61 determines whether or not the process cartridge(s) for which the operation for retracting the developer seal 46 was scheduled, that the suspect process cartridge is actually present, the engine controller 61 moves onto the next step, that is, Step (S62).

For the process cartridge(s) for which the operation for retracting the developer seal is scheduled, the operation for retracting the developer seal, which will be described next, is carried out.

For which process cartridge(s) the abovementioned developer seal retracting operation is scheduled is determined based on the data obtained in Steps (S43), (S45), (S50). Then, at least one of the developer seal retracting operations scheduled for the suspected process cartridge(s) is selected (S62). Then, the belt cleaning operation is carried out (S63), and the application of the transfer bias voltage is stopped (S64).

Then, the engine controller 61 selects the driving force transmission routes so that the driving force from the image forming apparatus main assembly 100 is transmitted only to the process cartridges for which the developer seal retracting operation has been scheduled (S65). Then, the engine controller 61 makes the display portion 64 display the information that the process cartridge(s) which is not ready for image formation is being initialized, or the like (S66).

Referring to FIG. 3, the driving force source, for example, motor 101, of the image forming apparatus main assembly 100 is driven to transmit the driving force to the process cartridge 7. As the driving force is transmitted to the process cartridge 7, it is transmitted to the driving gear train of the process cartridge 7. Then, it is transmitted to the winding shaft 54 through the developer supply roller 43. Consequently, the developer seal 46 is retracted, exposing the developer supply opening 41*e* of the developer container 41 (S67). In order to ensure that the developer seal 46 is completely retracted to fully expose the developer supply opening 41*e*, the driving force is continuously inputted for the predetermined length S (seconds) of time (S68).

The actually measured length of time necessary to completely remove the developer seal 46 from one of the process cartridges, that is, the length of time necessary to completely wind the developer seal 46, was roughly 20 seconds. In this embodiment, therefore, the predetermined length S of time is set to 20 seconds. After the elapse of the predetermined length S of time, the engine controller 61 carries out the above described Steps (S35)-(S38) of the operational sequence, only for the process cartridge(s), the developer seal of which had been determined by the engine controller 61 to be still covering the developer supply opening 41*e*. In other words, the engine controller 61 applies the transfer bias voltage for the process cartridge(s), the developer seal 46 of which has just been removed (S69). Then, it drives the development roller 40 (S70). Then, it applies the development bias for t0 seconds (S71). Then, it stops the driving of the development roller 40 (S72).

Thereafter, the engine controller 61 determines whether or not the developer image formed of the developer in the suspect process cartridge was detected by the developer image detection sensor 30*a* and developer image detection sensor 30*b* (S73 and S74). These steps yield the following Results E-F given in Table 2, which shows the relationship between the outputs of the developer image detection sensors 30*a* and 30*b*, and the readiness of the process cartridge for image formation.

TABLE 2

| Results | Snsr 30a | SnSr 30b | Process cartridge | Display |
|---|---|---|---|---|
| E | Y | Y | Operable | Operable |
| F | N | N | No cartridge No Dvlpr | No cartridge Malfunc. |
| G | N | Y | No Dvlpr Malfunc. | No Dvlpr |
| H | Y | N | No Dvlpr Malfunc. | No Dvlpr |

To describe in more detail, in these steps, the driving force is continuously transmitted long enough for the developer seal 46 to be completely retracted. Thus, Result E ought to be yielded, that is, the developer seal 46 is expected to be completely retracted. In this case, that is, when the developer images were detected by both the developer image detection sensors 30*a* and 30*b*, the engine controller 61 determines that the suspect process cartridge(s) has become ready, and displays the information that the suspect process cartridge(s) is ready (S75). Thereafter, it carries out the developer image erasing process (S77), and ends the process cartridge readiness determination sequence (S78).

Result G is indicates that the developer image detection sensor 30*a* detected the developer image (S73), but, the developer image detection sensor 30*a* did not detect the developer image (S74). Result H represents a case in which the developer image detection sensor 30*a* did not detect the developer image (S73), but, the developer image detection sensor 30*b* detected the developer image (S79). Regarding the state of the process cartridges, Results G and H represent the case that the developer container 41 has been completely depleted of developer (no developer), or the developer seal 46 could not be completely retracted due to an anomaly such as mechanical and/or electrical trouble, or the like. In these cases, the engine controller 61 displays on the display portion 64 the warning that the suspect process cartridge(s) is out of developer (S76). Then, it carries out the developer image erasing process (S77), and ends the process cartridge readiness determination sequence (S78).

As for Result F, it represents the case in which not only is there no output from the developer image detection sensor 30*a* (S73), but also, there is no output from the developer image detection sensor 30*b* (S79). In other words, in this case, it is possible, as the state of the process cartridge, that there is no process cartridge in the cartridge compartment of the apparatus main assembly for the suspect process cartridge, that the developer container 41 of the suspect process cartridge is out of developer (developer depletion), that the developer seal 46 could not be completely retracted due to some kind of anomaly such as mechanical and/or electrical trouble, or that the like problem occurred. In this case, the engine controller 61 shuts off the high voltage power source 62 (S80), and makes the driving portion 66 stop inputting the driving force (S81). Then, it displays on the display portion 64 the anomaly warning that no process cartridge is in the cartridge compartment for the suspect process cartridge (S82), and ends the process cartridge readiness determination sequence (S83).

If there are two or more suspect process cartridges, the determination has only to be made when the portions of the conveyer belt 11, across which the corresponding developer images are to be formed, pass by the developer image detection sensors at times T(1), T(2), T(3), and T(4) in Steps (S73, S74, and S79) in which the presence or absence of the developer images are to be detected by the developer image detection sensors 30*a* and 30*b*. For example, the conditions of the process cartridges for the third and first colors can be determined based on the outputs sent to the engine controller 61 from the developer image detection sensors 30*a* and 30*b* T(3) seconds and T(1) seconds after the development bias. As for the order in which the developer images pass by the developer image detection sensors 30*a* and 30*b*, in this case, the developer image of the third color is the first one and the developer image of the first color is the next one. Therefore, it is preferable that the operational sequence is programmed so that the engine controller 61 does not advance to the developer image erasing step (S77) and high voltage application stopping step (S80), until the developer image of the last color passes by the developer image detection sensors 30*a* and 30*b*.

As described above, when the condition of the process cartridges is determined based on the combination of the outputs from two developer image detection sensors 30*a* and 30*b*, it can be determined in more detail. Thus, as the results of the determination are displayed on the display portion 64, a user is given more detailed information about the condition of the process cartridges.

Incidentally, in the preceding embodiments, it was the conveyer belt 11 that the developer images to be detected were transferred onto. However, the preceding embodiments are not intended to limit the scope of the present invention. In other words, as long as the developer supplied from within a given developer container can be detected, the medium onto which the developer image is transferred for the process cartridge readiness sequence does not need to be the conveyer belt 11. For example, it may be an electrophotographic photosensitive member. Further, the transfer medium onto which the developer images are transferred for the process cartridge readiness sequence may be an intermediary transfer member, on which the developer image formed on (adhered to) an electrophotographic photosensitive member is temporarily held to be transferred onto recording medium. Moreover, the development roller 40 can also be used as an object from which process cartridge readiness can be determined.

In the preceding embodiments described above, when no output can be obtained from the developer image detection sensor 30, the developer seal retracting operation was carried out. However, the developer seal retracting operation may be carried out based on the result of the comparison between a predetermined value (threshold value) set for the developer image detection sensor 30, and the actual output of the developer image detection sensor 30.

Also in the preceding embodiments, the condition that the developer supply opening 41*e* remains sealed with the developer seal 46 includes not only the condition that the opening 41*e* is completely sealed by the developer seal 46, but also, the condition that opening 41*e* is partially sealed with the developer seal 46 (partially open).

Also in the preceding embodiments, the developer image detection sensor 30 as a developer detecting means was enabled to detect the density of a developer image in order to measure the density of a developer image to control such factors as density that affects the image formation condition. However, it is not mandatory for the developer image detection sensor 30 to have such a function. However, by employing the developer image detection sensor 30 capable of detecting the density of the developer image formed for controlling the image formation condition, the developer image detection sensor 30 can be doubled as the sensor for removing the developer seal 46, eliminating the need for providing an image forming apparatus with an additional sensor dedicated for removing the developer seal 46.

As for the type of developer with which the present invention is compatible, the present invention is compatible with both single-component developer and two-component developer.

As described above, the present invention can eliminate the need for the manual chore which a user has to perform to remove the developer seal to expose the developer supply opening of a process cartridge, when putting a brand-new process cartridge to use for the first time.

Further, according to the present invention, it is possible to detect that the developer supply opening of a process cartridge is not exposed, by detecting that the amount of the developer adhering to a predetermined medium is no more than a predetermined value.

Also according to the present invention, the sealing member can be automatically retracted from the position in which it covers the developer supply opening, by detecting the amount of the developer adhering to a predetermined medium is no more than a predetermined value.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 106285/2004 filed Mar. 31, 2004, which is hereby incorporated by reference.

What is claimed is:

1. An electrophotographic image forming apparatus for forming an image on a recording material, comprising:

a) a main assembly to which a cartridge is detachably mountable, the cartridge including:

a developer accommodating portion configured to accommodate a developer for developing an electrostatic latent image formed on an electrophotographic photosensitive member;

a developing roller configured and positioned to develop an electrostatic latent image with the developer;

a developer supply opening configured and positioned to supply the developer to the developing roller from the developer accommodating portion; and a sealing member configured and positioned to unsealably seal the developer supply opening over a range from one longitudinal end to the other longitudinal end of the developer supply opening, with respect to a longitudinal direction of the developing roller;

b) first developer detecting means for detecting whether the amount of the developer deposited on a member to be detected is less than a predetermined level adjacent to the one longitudinal end;

c) second developer detecting means for detecting whether the amount of the developer deposited on a member to be detected is less than a predetermined level adjacent to the other longitudinal end; and d) discriminating means for descriminating a state of the sealing member on the basis of a result of detection of said first developer detecting means and said second developer detecting means.

2. An apparatus according to claim 1, wherein the electrophotographic photosensitive member is the member to be detected.

3. An apparatus according to claim 1, wherein said image forming apparatus is a color electrophotographic image forming apparatus, and the developer accommodating portion includes a plurality of the cartridges for containing respective color developers, wherein said color electrophotographic image forming apparatus further comprises a conveyer belt configured and positioned to convey the recording material and to transfer a developed image formed on the electrophotographic photosensitive member onto the recording material, and wherein said conveyer belt is the member to be detected.

4. An apparatus according to claim 1, wherein said electrophotographic image forming apparatus is capable of forming a developed image to be detected to detect an image density and control an image forming condition of said electrophotographic image forming apparatus in accordance with a result of detecting the image density, and wherein said first and second developer detecting means detect the density of the image to be detected.

5. An apparatus according to claim 1, wherein the cartridge is a process cartridge containing electrophotographic photosensitive member as a unit.

6. Apparatus according to claim 1, wherein the sealing member is removable from said one end to the other end of the developer supply opening.

7. An apparatus according to claim 1, wherein said discriminating means is capable of producing an electrical signal for retracting the sealing member sealing the developer supply opening from a sitting position when said sealing member seals said developer supply opening.

8. An apparatus according to claim 7, wherein when said first and second developer detecting means detect that an amount of developer exceeding the predetermined level is not deposited on the member to be detected, said discriminating means produces an electrical signal representing the state that the amount of developer exceeding a predetermined level supplied to the developing roller from the developer accommodating portion is not deposited on the member to be detected.

9. An apparatus according to claim 8, further comprising notification means for providing a notification of the state of the cartridge, wherein after said discriminating means produces the electrical signal, i) when said first detecting means and said second detecting means detect that the amount of developer exceeding the predetermined level is deposited on the member to be detected, said discriminating means notifies said notification means that the cartridge is in a state in which the cartridge is capable of image formation, ii) when said first detecting means and said second detecting means detect that the amount of developer exceeding the predetermined level is not deposited on the member to be detected, said discriminating means notifies said notification means that the cartridge is in a state in which the cartridge is not mounted to the main assembly of the apparatus, and iii) when one of said first detecting means and said second detecting means detects that the amount of developer exceeding the predetermined level is deposited on the member to be detected, and the other of said first detecting means and said second detecting means detects that the amount of the developer exceeding the predetermined level is not deposited on the member to be detected, said discriminating means notifies said notification means that the cartridge is in a malfunction state or a state in which the developer accommodating portion is empty.

10. An apparatus according to claim 7, further comprising notification means for providing a notification of a state of said cartridge, i) when said first detecting means and the second detecting means detect that the amount of developer exceeding the predetermined level is deposited on the member to be detected, said discriminating means notifies said notification means that the cartridge is in a state in which the cartridge is capable of image formation, ii) when said first detecting means detects that the amount of developer exceeding the predetermined level is not deposited on the member to be detected, said discriminating means produces an electrical signal, and iii) when one of said first detecting means and said second detecting means detects that the amount of developer exceeding the predetermined level is deposited on the member to be detected, and the other one of said first detecting means and said second detecting means detects that the amount of developer exceeding the predetermined level is not deposited on the member to be detected, said discriminating means notifies said notification means that the cartridge is in a malfunction state or a state in which the developer accommodating portion is empty.

11. An apparatus according to claim 10, wherein when said first detecting means and said second detecting means detect, after said discriminating means produces the electrical signal, that the amount of developer exceeding the predetermined level is not deposited on the member to be detected, i) when said first detecting means and the second detecting means detect that an amount of developer exceeding the predetermined level is deposited on the member to be detected, said discriminating means notifies notification means that the cartridge is in a state in which the cartridge is capable of image formation, ii) when said first detecting means and said second detecting means detect that an amount of developer exceeding the predetermined level is not deposited on the member to be detected, said discriminating means notifies the notification means that the cartridge is in a state in which the cartridge is not mounted to the main assembly of the apparatus, and iii) when one of said first detecting means and said second detecting means detects that an amount of developer exceeding the predetermined level is deposited on the member to be detected, and the other of said first detecting means and said second detecting means detects that an amount of developer exceeding the predetermined level is not deposited on the member to be detected, said discriminating means notifies the notification means that the cartridge is in a malfunction state or a state in which the developer accommodating portion is empty.

* * * * *

UNITED STATES PATENT AND TRADEMARK OFFICE

CERTIFICATE OF CORRECTION

PATENT NO. : 7,277,659 B2
APPLICATION NO. : 11/092874
DATED : October 2, 2007
INVENTOR(S) : Tetsuya Kobayashi et al.

It is certified that error appears in the above-identified patent and that said Letters Patent is hereby corrected as shown below:

ON THE COVER PAGE

At Item (57), Abstract, line 3, "pottion" should read --a portion--.
Line 12, "amount" should read --an amount--.
Line 18, "amount" should read --the amount--.

IN THE DRAWINGS

Figure 18A:
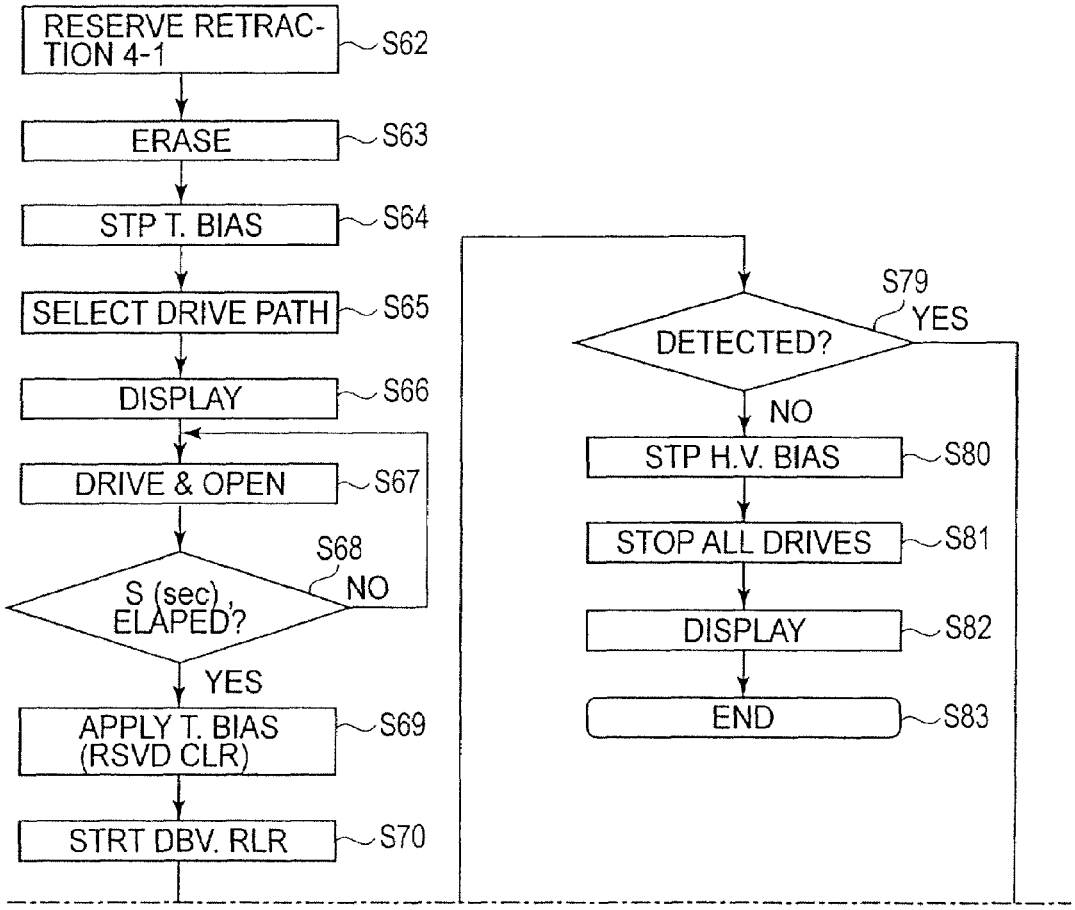
FIG. 18 is a flowchart of the sealing member winding operation in the first embodiment of the present invention.
Figure 18B:
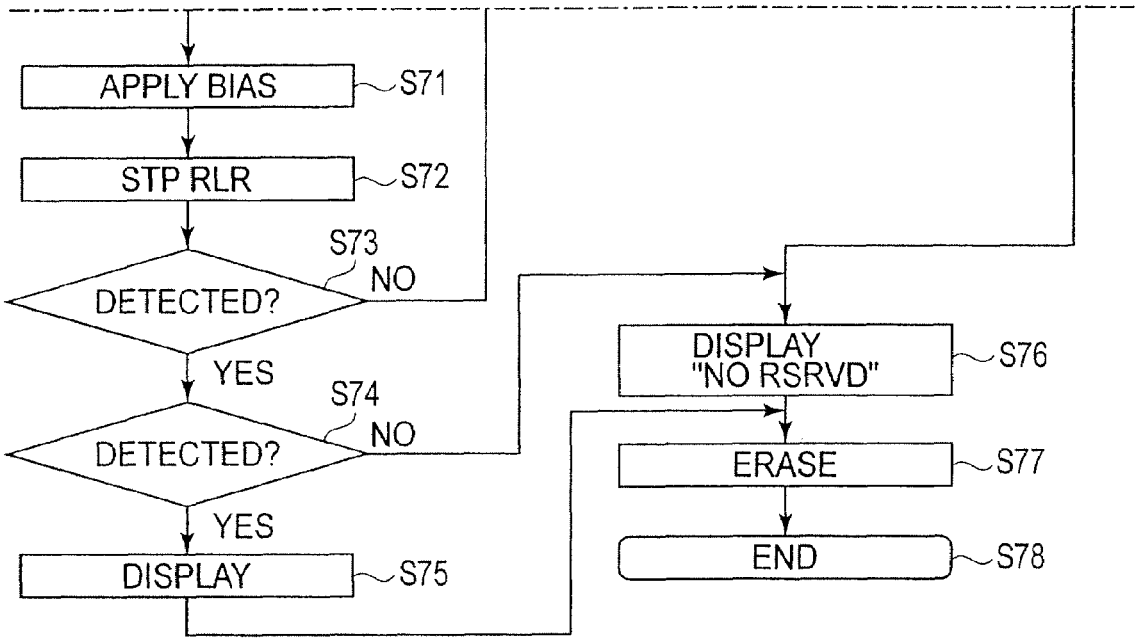
Figure 18:
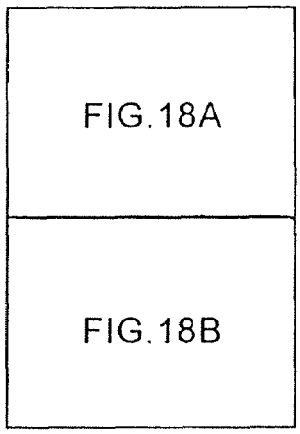

Sheet 9, Fig. 9A, "ELAPED" should read --ELAPSED--.
Sheet 19, Fig. 17B, "DETECED" (both occurrences) should read --DETECTED--.
Sheet 20, Fig. 18A, "ELAPED" should read --ELAPSED--.

COLUMN 1

Line 63, "photosensitive" should read --a photosensitive--.

COLUMN 6

Line 6, "being give" should read --being given--.

COLUMN 8

Line 1, "7astoring" should read --7a storing--.

COLUMN 9

Line 50, "the peripheral surface of" should be deleted.

COLUMN 10

Line 15, "developer" should read --the developer--.

COLUMN 11

Line 47, "αrelative" should read --α relative--.

COLUMN 12

Line 1, "describing" should read --described--.

COLUMN 13

Line 11, "and 40c" should read --and 40d--.

UNITED STATES PATENT AND TRADEMARK OFFICE

CERTIFICATE OF CORRECTION

PATENT NO. : 7,277,659 B2
APPLICATION NO. : 11/092874
DATED : October 2, 2007
INVENTOR(S) : Tetsuya Kobayashi et al.

It is certified that error appears in the above-identified patent and that said Letters Patent is hereby corrected as shown below:

COLUMN 14
Line 5, “had already” should read --has already--.
Line 36, “be not” should read --not be--.

COLUMN 16
Line 27, “cartridge” should read --cartridge(s),--.
Line 28, “(s),” should be deleted and “seals (46)” should read --seal (46)--.
Line 61, “been” should read --had been--.

COLUMN 20
Line 3, “voltage)to” should read --voltage) to--, and “and 40c” should read --and 40d--.
Line 23, “transfeffed” should read --transferred--.
Line 34, “This” should read --These--.
Line 48, “developer” should read --developers--.

COLUMN 21
Line 20, “possibility” should read --the possibility--.
Line 46, “is schedule,” should read --is scheduled,--.

COLUMN 24
Line 45, “is indicates” should read --indicates--.

COLUMN 26
Line 10, “affects” should read --affect--.

COLUMN 27
Line 8, “descriminating” should read --discriminating--.
Line 34, “containing” should read --containing the--.
Line 36, “Apparatus” should read --An apparatus--.

UNITED STATES PATENT AND TRADEMARK OFFICE

CERTIFICATE OF CORRECTION

PATENT NO. : 7,277,659 B2
APPLICATION NO. : 11/092874
DATED : October 2, 2007
INVENTOR(S) : Tetsuya Kobayashi et al.

It is certified that error appears in the above-identified patent and that said Letters Patent is hereby corrected as shown below:

COLUMN 28
Line 16, “the second” should read --said second--.
Line 42, “the second” should read --said second--.

Signed and Sealed this

Third Day of February, 2009

JOHN DOLL
*Acting Director of the United States Patent and Trademark Office*